US010280804B2

(12) United States Patent
Apte

(10) Patent No.: US 10,280,804 B2
(45) Date of Patent: May 7, 2019

(54) THERMOCLINE ARRAYS

(71) Applicant: Malta Inc., Cambridge, MA (US)

(72) Inventor: Raj Apte, Mountain View, CA (US)

(73) Assignee: Malta Inc., Cambridge, MA (US)

( * ) Notice: Subject to any disclaimer, the term of this patent is extended or adjusted under 35 U.S.C. 154(b) by 0 days.

(21) Appl. No.: 15/393,874

(22) Filed: Dec. 29, 2016

(65) Prior Publication Data

US 2018/0187572 A1 Jul. 5, 2018

(51) Int. Cl.

| | |
|---|---|
| ***F01K 3/12*** | (2006.01) |
| ***F22B 1/00*** | (2006.01) |
| ***F01K 7/38*** | (2006.01) |
| ***F01K 25/06*** | (2006.01) |
| ***F01K 3/02*** | (2006.01) |
| ***F01K 25/10*** | (2006.01) |
| ***F01K 3/06*** | (2006.01) |
| ***F01K 3/18*** | (2006.01) |
| ***F01K 13/02*** | (2006.01) |

(52) U.S. Cl.

CPC ..... *F01K 3/12* (2013.01); *F01K 3/02* (2013.01); *F01K 3/06* (2013.01); *F01K 3/18* (2013.01); *F01K 7/38* (2013.01); *F01K 13/02* (2013.01); *F01K 25/103* (2013.01); *F22B 1/006* (2013.01); *F01K 25/06* (2013.01)

(58) Field of Classification Search

CPC ..... F01K 3/12; F01K 25/06; F01K 25/103; F01K 3/02; F01K 7/16; F25B 25/005; F25B 9/06; F25B 9/00; F25B 13/00; F25B 2400/14

USPC ..... 60/650, 682–684

See application file for complete search history.

(56) References Cited

U.S. PATENT DOCUMENTS

| | | | |
|---|---|---|---|
| 2,065,974 | A | 12/1936 | Marguerre |
| 2,246,513 | A | 6/1941 | Hammond |
| 2,791,204 | A | 5/1957 | Andrus |
| 2,860,493 | A | 11/1958 | Capps et al. |
| 3,152,442 | A | 10/1964 | Rowekamp |
| 3,220,191 | A | 11/1965 | Berchtold |
| 3,630,022 | A | 12/1971 | Jubb |
| 3,897,170 | A | 7/1975 | Darvishian |
| 3,955,359 | A | 5/1976 | Yannone et al. |
| 4,024,908 | A | 5/1977 | Meckler |

(Continued)

FOREIGN PATENT DOCUMENTS

| | | |
|---|---|---|
| DE | 202013004654 | 8/2014 |
| EP | 0003980 A1 | 9/1979 |

(Continued)

OTHER PUBLICATIONS

International Search Report and Written Opinion, International Application No. PCT/US2017/063289, dated Apr. 16, 2018.

(Continued)

*Primary Examiner* — Hoang M Nguyen
(74) *Attorney, Agent, or Firm* — McDonnell Boehnen Hulbert & Berghoff LLP

(57) ABSTRACT

Thermocline arrays comprising a plurality of pressure vessels that are in used in place of heat exchangers in a closed thermodynamic cycle system, such as a closed Brayton cycle power generation or energy storage system. Each pressure vessel is configurable to be connected to the working fluid stream or isolated from the working fluid stream.

20 Claims, 11 Drawing Sheets

(56) References Cited

U.S. PATENT DOCUMENTS 4,054,124 A 10/1977 Knoos
4,089,744 A 5/1978 Cahn
4,094,148 A 6/1978 Nelson
4,110,987 A 9/1978 Cahn et al.
4,148,191 A * 4/1979 Frutschi ..... F02C 9/24 60/652
4,158,384 A 6/1979 Brautigam
4,215,553 A * 8/1980 Poirier ..... F02C 1/05 165/104.34
4,408,654 A 10/1983 Doomernik
4,430,241 A 2/1984 Fiorucci
4,444,024 A 4/1984 McFee
4,438,630 A 10/1984 Yamaoka et al.
4,479,352 A 10/1984 Yamaoka et al.
4,523,629 A 6/1985 Copeland
4,583,372 A * 4/1986 Egan ..... C23C 16/4485 62/50.1
4,628,692 A 12/1986 Pierce
4,643,212 A 2/1987 Rothrock
4,727,930 A 3/1988 Bruckner et al.
5,269,145 A 12/1993 Krause et al.
5,537,822 A 7/1996 Shnaid et al.
5,644,928 A 7/1997 Uda et al.
5,653,656 A 8/1997 Thomas et al.
5,653,670 A 8/1997 Endelman
6,119,682 A 9/2000 Hazan
6,629,413 B1 * 10/2003 Wendt ..... F02C 1/04 60/655
6,644,062 B1 11/2003 Hays
6,701,711 B1 3/2004 Litwin
7,028,481 B1 4/2006 Morrow
7,086,231 B2 * 8/2006 Pinkerton ..... F02C 1/05 60/650
7,299,633 B2 11/2007 Murphy et al.
7,458,418 B2 12/2008 Sienel
7,603,858 B2 10/2009 Bennett
7,937,930 B1 5/2011 Dunn
7,954,320 B2 6/2011 Ellensohn et al.
8,113,011 B2 2/2012 Howes et al.
8,206,075 B2 6/2012 White et al.
8,403,613 B2 3/2013 van der Meulen
8,424,284 B2 4/2013 Staffend et al.
8,453,677 B2 6/2013 Howes et al.
8,496,026 B2 7/2013 Howes et al.
8,500,388 B2 8/2013 van der Meulen et al.
8,613,195 B2 12/2013 Held et al.
8,656,712 B2 2/2014 Howes et al.
8,671,686 B2 * 3/2014 Pinkerton ..... G06F 1/30 60/646
8,826,664 B2 9/2014 Howes et al.
8,833,079 B2 9/2014 Smith
8,833,101 B2 9/2014 Howes et al.
8,863,641 B2 10/2014 Howes
8,904,793 B2 12/2014 Hemrle et al.
9,316,121 B2 4/2016 Davidson et al.
9,518,786 B2 * 12/2016 Howes ..... F01K 3/12
2001/0054449 A1 12/2001 Jones et al.
2003/0131623 A1 7/2003 Suppes
2004/0008010 A1 1/2004 Ebrahim et al.
2004/0083731 A1 5/2004 Lasker
2004/0088980 A1 5/2004 Emmel et al.
2005/0126171 A1 6/2005 Lasker
2006/0035591 A1 2/2006 Young et al.
2006/0053792 A1 3/2006 Bourgeois
2006/0137869 A1 6/2006 Steinhauser
2006/0185626 A1 8/2006 Allen et al.
2006/0248886 A1 11/2006 Ma
2007/0295673 A1 12/2007 Enis et al.
2008/0121387 A1 5/2008 Taniguchi et al.
2009/0126377 A1 5/2009 Shibata et al.
2009/0179429 A1 7/2009 Ellis et al.
2010/0024421 A1 2/2010 Litwin et al.
2010/0251711 A1 10/2010 Howes et al.
2010/0251712 A1 10/2010 Nakhamkin
2010/0257862 A1 10/2010 Howes et al.
2010/0275616 A1 11/2010 Saji et al.
2010/0301062 A1 12/2010 Litwin et al.
2010/0301614 A1 12/2010 Ruer
2011/0100010 A1 5/2011 Freund et al.
2011/0100011 A1 5/2011 Staffend
2011/0100356 A1 5/2011 Bliesner
2011/0100611 A1 5/2011 Ohler et al.
2011/0126539 A1 6/2011 Ramaswamy et al.
2011/0139407 A1 6/2011 Ohler et al.
2011/0196542 A1 8/2011 Pinkerton et al.
2011/0227066 A1 9/2011 Umezaki
2011/0262269 A1 10/2011 Lior
2011/0277471 A1 11/2011 Shinnar
2011/0283700 A1 11/2011 Zohar et al.
2011/0289941 A1 12/2011 Gonzalez et al.
2011/0314839 A1 12/2011 Brook et al.
2012/0039701 A1 2/2012 Diddi et al.
2012/0047892 A1 3/2012 Held et al.
2012/0055661 A1 3/2012 Feher
2012/0060501 A1 3/2012 Hemrle et al.
2012/0222423 A1 9/2012 Mercangoez et al.
2012/0267955 A1 10/2012 Zhan et al.
2012/0312496 A1 12/2012 Howes et al.
2012/0319410 A1 12/2012 Ambrosek et al.
2013/0105127 A1 5/2013 Postma et al.
2013/0118344 A1 5/2013 Howes et al.
2013/0125546 A1 5/2013 Barmeier et al.
2013/0276917 A1 10/2013 Howes et al.
2014/0008033 A1 1/2014 Howes et al.
2014/0014290 A1 1/2014 Howes et al.
2014/0014302 A1 1/2014 Gutai
2014/0060051 A1 3/2014 Ohler et al.
2014/0075970 A1 3/2014 Benson
2015/0034188 A1 2/2015 Howes
2015/0069758 A1 3/2015 Davidson et al.
2015/0084567 A1 3/2015 Howes
2015/0113940 A1 4/2015 Sinatov et al.
2015/0114217 A1 4/2015 Howes
2015/0114591 A1 4/2015 Howes et al.
2015/0211386 A1 7/2015 Howes et al.
2015/0260463 A1 9/2015 Laughlin et al.
2015/0267612 A1 * 9/2015 Bannari ..... F01D 15/02 60/650
2015/0361832 A1 12/2015 Franke et al.
2016/0018134 A1 1/2016 Ueda et al.
2016/0030856 A1 2/2016 Kaplan et al.
2016/0032783 A1 2/2016 Howes et al.
2016/0248299 A1 8/2016 Ouvry
2016/0290281 A1 10/2016 Schmatz
2016/0298455 A1 10/2016 Laughlin
2016/0298495 A1 10/2016 Laughlin

FOREIGN PATENT DOCUMENTS

EP 1577548 A1 9/2005
EP 1857614 A2 11/2007
EP 2241737 A1 10/2010
EP 2275649 A1 1/2011
EP 2312129 A1 4/2011
EP 2390473 A1 11/2011
EP 2400120 A1 12/2011
EP 2441925 A1 4/2012
EP 2441926 A1 4/2012
EP 2532843 A1 12/2012
JP 08-93633 A 4/1996
JP 2011106755 6/2011
KR 1020040045337 6/2004
KR 1020120042921 5/2012
KR 101370843 3/2014
KR 1020150089110 8/2015
WO 2005/019756 3/2005
WO 2011/161094 12/2011
WO 2013/094905 6/2013
WO 2013164563 A1 11/2013

(56) References Cited

FOREIGN PATENT DOCUMENTS

| | | |
|---|---|---|
| WO | 2015/185891 | 10/2015 |
| WO | 2016/000016 | 1/2016 |

OTHER PUBLICATIONS

Desrues et al., "A Thermal Energy Storage Process for Large Scale Electric Applications", Applied Thermal Engineering 30 (2010): 425-432, Oct. 14, 2009.
Ruer et al., "Pumped Heat Energy Storage", pp. 1-14, Apr. 2010.
Bauer et al., "Sodium nitrate for high temperature latent heat storage", 11th International Conference,Thermal Energy Storage Effstock, Jun. 14, 2009.
Bradshaw et al., "Molten Nitrate Salt Development for Thermal Energy Storage inParabolic Trough Solar Power Systems", ES2008-54174, ASME 2008 2nd International Conference on Energy Sustainability, vol. 2, (2008), p. 631.
Dewing, Ernest W., "Heat Capacities of Liquid Sodium and Potassium Nitrates", Journal of Chemical and Engineering Data, 1975; 20(3): 221-223.
Diguilio et al., "The Thermal Conductivity of the Molten NaN03-KN03 Eutectic Between 525 and 590 K", International Journal of Thermophysics, 1992; 13(4):575-592.
Freeman, Eli S., "The Kinetics of the Thermal Decomposition of Sodium Nitrate and of the Reaction Between Sodium Nitrate and Oxygen", J. Ohys. Chern., Nov. 1956, 60(11):1487-1493.
Isentropic, "A new era in electrical energy storage and recovery", 2014, <http://www.isentropic.co.uk/our-phes-technology>.
Laughlin, Robert, "Here Comes the Sun", Stanford Physics Department Colloquium, Jan. 5, 2010.
Nunes et al., "Viscosity of Molten Sodium Nitrate", International Journal of Thermophysics, 2006; 27(6):1638-1649.
Parsons, "Cost Estimates for Thermal Peaking Power Plant", Parsons Brinckerhoff New Zealand Ltd., 2008.
Peng et al., "High-temperature thermal stability of molten salt materials", Int. J. Energy Res., 2008; 32:1164-1174.
Pickett, et al., "Heated Turbulent Flow of Helium-Argon Mixtures in Tubes", International Journal of Heat and Mass Transfer, 22:705-719, 1979.
Raade, et al., "Development of Molten Salt Heat Transfer Fluid With Low Melting Point and High Thermal Stability", Journal of Solar Energy Engineering, 133:031013-1-031013-6, 2011.
Silverman, et al., "Survey of Technology for Storage of Thermal Energy in Heat Transfer Salt", Oak Ridge National Laboratory, ORNL/TM-5682, Jan. 1977.
Vanco, Michael R., "Analytical Comparison of Relative Heat-Transfer Coefficients and Pressure Drops of Inert Gases and Their Binary Mixtures", U.S. National Aeronautics and Space Administration, NASA TN D-2677, Feb. 1965.
Yergovich, et al., "Density and Viscosity of Aqueous Solutions of Methanol and Acetone from the Freezing Point to 10° C.", Journal of Chemical and Engineering Data, 16(2):222-226, 1971.
Zabransky, et al., "Heat Capacities of Organic Compounds in the liquid State I. C1 to C18 1-Alkanols", Journal of Physical and Chemical Reference Data, 19(3):719-762, 1990.
Way, Julie, "Storing the Sun: Molten Salt Provides Highly Efficient Thermal Storage", <http://www.renewableenergyworld.com/articles/2008/06/storing-the-sun-molten-salt-provides-highly-efficient-thermal-storage-52873.html>, Jun. 26, 2008.
Wesoff, Eric, "Breakthrough in Energy Storage: Isentropic Energy", <https://www.greentechmedia.com/articles/read/breakthrough-in-utility-scale-energy-storage-isentropic>, Feb. 23, 2010.
Turchi, Craig, "NREL Advanced Concepts", Solar Energy Technologies Program Peer Review, May 27, 2010.
Boyce, Meherwan P., "Axial-Flow compressors", 2003 (date estimated), Internet.
Frutschi, Hans Ulrich, "Closed-Cycle Gas Turbines", New York, NY, ASME, 2005, <http://ebooks.asmedigitalcollection.asme.org/books.aspx>, Jan. 29, 2016.
Office action dated Mar. 28, 2013 for U.S. Appl. No. 12/932,775.
Office action dated Jan. 9, 2014 for U.S. Appl. No. 12/932,775.
Office action dated Feb. 26, 2015 for U.S. Appl. No. 12/932,775.
Office action dated Dec. 4, 2015 for U.S. Appl. No. 13/965,048.
Office action dated Nov. 6, 2015 for U.S. Appl. No. 12/932,775.
International search report and written opinion dated Jan. 2, 2014 for PCT/US2013/062469.
International preliminary report on patentability and written opinion dated Mar. 31, 2015 for PCT/US2013/062469.
Macnaghten, James, "Commercial potential of different large scale thermal storage technologies under development globally", Isentropic LTD, Jun. 9, 2016.
U.S. Appl. No. 14/668,610, filed Mar. 25, 2015.
U.S. Appl. No. 13/965,048, filed Aug. 12, 2013.
U.S. Appl. No. 12/932,775, filed Mar. 4, 2011.
Patent Cooperation Treaty Application Serial No. PCT/US2013/062469, filed Sep. 27, 2013.
U.S. Appl. No. 61/706,337, filed Sep. 27, 2012.
U.S. Appl. No. 61/868,070, filed Aug. 20, 2013.
U.S. Appl. No. 61/339,577, filed Mar. 4, 2010.
U.S. Appl. No. 15/392,653, filed Dec. 28, 2016.
U.S. Appl. No. 15/392,542, filed Dec. 28, 2016.
U.S. Appl. No. 15/392,523, filed Dec. 28, 2016.
U.S. Appl. No. 15/392,927, filed Dec. 28, 2016.
U.S. Appl. No. 15/392,657, filed Dec. 28, 2016.
U.S. Appl. No. 15/392,571, filed Dec. 28, 2016.
International Searching Authority, International Search Report and Written Opinion, dated Apr. 12, 2018, issued in connection with International Patent Application No. PCT/US2017/063519, field Nov. 28, 2017, 16 pages.
International Searching Authority, International Search Report and Written Opinion, dated Mar. 26, 2018, issued in connection with International Patent Application No. PCT/US2017/065645, filed Dec. 11, 2017, 16 pages.
International Searching Authority, International Search Report and Written Opinion, dated Mar. 27, 2018, issued in connection with International Patent Application No. PCT/US2017/065201, filed Dec. 7, 2017, 13 pages.
International Searching Authority, International Search Report and Written Opinion, dated Feb. 26 2018, issued in connection with International Patent Application No. PCT/US2017/064074, filed Nov. 30, 2017, 13 pages.
International Searching Authority, International Search Report and Written Opinion, dated Mar. 26, 2018, issued in connection with International Patent Application No. PCT/US2017/065200, filed on Dec. 7, 2017, 15 pages.
International Searching Authority, International Search Report and Written Opinion, dated Mar. 20, 2018, issued in connection with International Patent Application No. PCT/US2017/064839, filed on Dec. 6, 2017, 13 pages.
International Searching Authority, International Search Report and Written Opinion, dated Mar. 29, 2018, issued in connection with International Patent Application No. PCT/US2017/065643, filed on Dec. 11, 2017, 17 pages.
International Searching Authority, International Search Report and Written Opinion, dated Feb. 22, 2018, issued in connection with International Patent Application No. PCT/US2017/062117, filed Nov. 17, 2017, 17 pages.
International Searching Authority, International Search Report and Written Opinion, dated Mar. 12, 2018, issued in connection with International Patent Application No. PCT/US2017/063521, filed Nov. 28, 2017, 18 pages.
International Searching Authority, International Search Report and Written Opinion, dated Mar. 29, 2018, issued in connection with International Patent Application No. PCT/US2017/067049, filed Dec. 18, 2017, 16 pages.
Non-Final Office Action dated May 14, 2018, issued in connection with U.S. Appl. No. 15/392,653, filed Dec. 28, 2016, 26 pages.
Non-Final Office Action dated Nov. 3, 2016, issued in connection with U.S. Appl. No. 12/932,775, filed Mar. 4, 2011, 17 pages.
Final Office Action dated Jul. 25, 2017, issued in connection with U.S. Appl. No. 12/932,775, filed Mar. 4, 2011, 19 pages.

(56) References Cited

OTHER PUBLICATIONS

Non-Final Office Action dated Feb. 8, 2018, issued in connection with U.S. Appl. No. 15/396,461, filed Dec. 31, 2016, 9 pages.
Non-Final Office Action dated May 14, 2018, issued in connection with U.S. Appl. No. 15/392,657, filed Dec. 28, 2016, 27 pages.
Apte et al., U.S. Appl. No. 15/393,891, filed Dec. 29, 2016, 42 pages.
Apte et al., U.S. Appl. No. 15/394,572, filed Dec. 29, 2016, 114 pages.
Apte et al., U.S. Appl. No. 15/395,040, filed Dec. 30, 2016, 53 pages.
Apte et al., U.S. Appl. No. 15/395,622, filed Dec. 30, 2016, 101 pages.
International Searching Authority, International Search Report and Written Opinion dated Jul. 30, 2018, issued in connection with International Patent Application No. PCT/US2017/064076, filed on Nov. 30, 2017, 15 pages.
Final Office Action dated Jun. 6, 2018, issued in connection with U.S. Appl. No. 15/396,461, filed Dec. 31, 2016, 10 pages.
Non-Final Office Action dated Jun. 28, 2018, issued in connection with U.S. Appl. No. 15/392,927, filed Dec. 28, 2016, 11 pages.

* cited by examiner

THERMOCLINE ARRAYS

BACKGROUND

In a heat engine or heat pump, a heat exchanger may be employed to transfer heat between a thermal storage medium and a working fluid for use with turbomachinery. The heat engine may be reversible, e.g., it may also be a heat pump, and the working fluid and heat exchanger may be used to transfer heat or cold to a plurality of thermal stores.

SUMMARY

In a closed thermodynamic cycle, such as a closed Brayton cycle for power generation and/or energy storage, a pressure vessel containing solid thermal medium in a thermocline array arrangement may be used in place of a fluid-to-fluid heat exchangers.

Example thermocline systems may include an inlet fluid path, wherein the inlet fluid path receives a working fluid at a working pressure, and wherein the working pressure is not atmospheric pressure. Example thermocline systems may further include an outlet fluid path and a plurality of pressure vessels, wherein each pressure vessel may further include an interior volume, an inlet valve configured to connect or isolate the interior volume to or from the inlet fluid path, an outlet valve configured to connect or isolate the interior volume to or from the outlet fluid path, and thermal insulation configured to thermally insulate the pressure vessel from the atmosphere and from each other pressure vessel in the plurality of pressure vessels. Example thermocline systems may further include solid thermal storage medium within the interior volume of each insulated pressure vessel, wherein at least one pressure vessel interior volume is connected to the inlet fluid path and the outlet fluid path, wherein at least one pressure vessel interior volume is isolated from the inlet fluid path and the outlet fluid path, wherein each pressure vessel interior volume connected to the inlet fluid path and the outlet fluid path is at the working pressure, and wherein each pressure vessel interior volume isolated from the inlet fluid path and the outlet fluid path is at a storage pressure that is not the working pressure.

Example methods may include operating a closed thermodynamic cycle system in a discharge mode, wherein a working fluid stream is circulated through, in sequence, a compressor, a thermocline array, a turbine, and a cold side heat exchanger, wherein the thermocline array comprises a plurality of pressure vessels, wherein each pressure vessel is configurable to be connected to the working fluid stream or isolated from the working fluid stream, and wherein each pressure vessel contains a solid thermal storage medium configured to transfer thermal energy to the working fluid stream when the pressure vessel is connected to the working fluid stream. Example methods may further include connecting a first pressure vessel in the plurality of pressure vessels to the working fluid stream while a respective temperature of the solid thermal storage medium in the first pressure vessel is above a first threshold value. Example methods may further include isolating the first pressure vessel from the working fluid stream when the respective temperature of the thermal storage medium in the first pressure vessel falls below the first threshold value, and after the respective temperature of the solid thermal storage medium in the first pressure vessel falls below a second threshold value, connecting a second pressure vessel in the plurality of pressure vessels to the working fluid stream while a respective temperature of the solid thermal storage medium in the second pressure vessel is above a third threshold value.

Other example methods may include operating a closed thermodynamic cycle system in a charge mode, wherein a working fluid stream is circulated through, in sequence, a compressor, a thermocline array, a turbine, and a cold side heat exchanger, wherein the thermocline array comprises a plurality of pressure vessels, wherein each pressure vessel is configurable to be connected to the working fluid stream or isolated from the working fluid stream, and wherein each pressure vessel contains a solid thermal storage medium configured to receive thermal energy from the working fluid stream when the pressure vessel is connected to the working fluid stream. Example methods may further include connecting a first pressure vessel in the plurality of pressure vessels to the working fluid stream while a respective temperature of the solid thermal storage medium in the first pressure vessel is below a first threshold value. Example methods may further include isolating the first pressure vessel from the working fluid stream when the respective temperature of the thermal storage medium in the first pressure vessel rises above the first threshold value, and after the respective temperature of the solid thermal storage medium in the first pressure vessel rises above a second threshold value, connecting a second pressure vessel in the plurality of pressure vessels to the working fluid stream while a respective temperature of the solid thermal storage medium in the second pressure vessel is below a third threshold value.

These as well as other aspects, advantages, and alternatives, will become apparent to those of ordinary skill in the art by reading the following detailed description, with reference where appropriate to the accompanying drawings.

DETAILED DESCRIPTION

Figure 1:
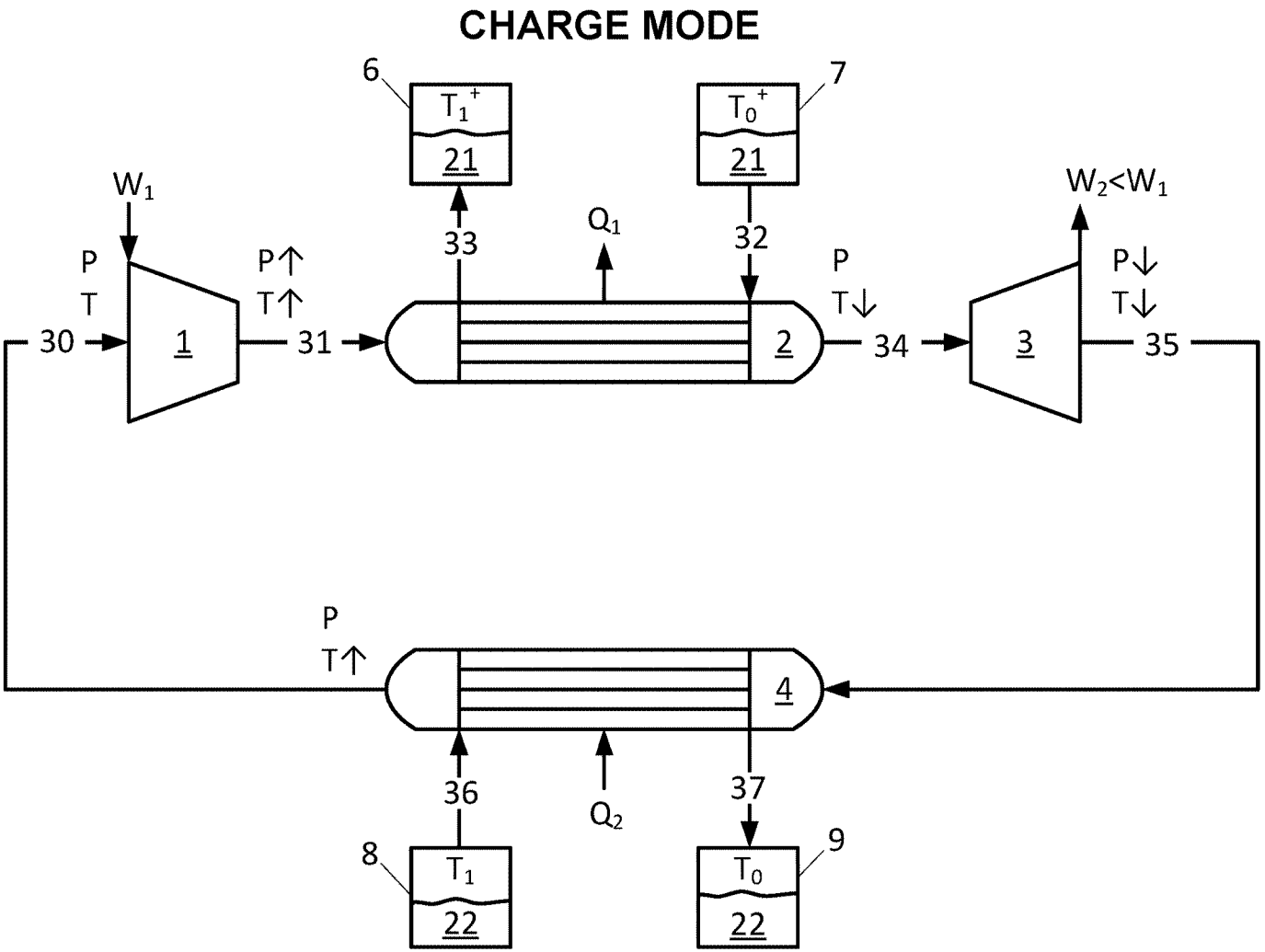
FIG. 1 is a schematic flow diagram of working fluid and heat storage media of a thermal system in a charge/heat pump mode.

Example methods and systems are described herein. It should be understood that the words "example" and/or "exemplary" are used herein to mean "serving as an example, instance, or illustration." Any embodiment or feature described herein as being an "example" or "exemplary" is not necessarily to be construed as preferred or advantageous over other embodiments or features. The example embodiments described herein are not meant to be limiting. It will be readily understood that certain aspects of the disclosed systems and methods can be arranged and combined in a wide variety of different configurations, all of which are contemplated herein.

I. Overview

An example reversible closed heat engine in which a thermocline array system may be implemented is a Brayton engine system. A Brayton engine system may use a generator/motor connected to a turbine and a compressor, where the turbomachinery acts on a working fluid circulating in the system. Non-comprehensive examples of working fluids include air, argon, carbon dioxide, or gaseous mixtures. A Brayton system may have a hot side and a cold side. Each side may include a heat exchanger vessel containing solid thermal medium. The solid thermal medium may take many forms, including but not limited to, dirt, rock, gravel, sand, clay, metal, metal oxide, refractory material, refractory metal, ceramic, cement, alumina, silica, magnesia, zirconia, silicon carbide, titanium carbide, tantalum carbide, chromium carbide, niobium carbide, zirconium carbide, molybdenum disilicide, calcium oxide, chromite, dolomite, magnesite, quartzite, aluminum silicate, tungsten, molybdenum, niobium, tantalum, rhenium, beryllium, and combinations thereof. Solid thermal medium for use in cold systems may further include water ice, and/or other solid forms of common room temperature liquids. Preferably, the solid medium is structurally stable at high or low temperature, of uniform shape and/or size, and shaped such that a bolus of solid medium includes gaps to allow a working fluid to flow through the bolus. For example, for refractory materials it may be preferable to utilize larges slabs, stackable bricks, platonic solids, spheres, cylinders, or other shapes that can be stacked and/or arranged to allow gaps between individual units of the solid medium. For metal, metal oxides, or ceramics it may be preferable to use those shapes or fabrics or meshes that consist entirely or partially of the metal, metal oxide, or ceramic, where the fabric or mesh has a porosity sufficient to allow passage of a working fluid through the solid medium.

Thermoclines may be used for thermal storage of energy, either for cooling or heating or both, depending on the requirements of the heat engine. Thermoclines, which may be configured as a heat exchanger vessel with pelletized thermal storage medium, generally need to be kept at the inlet pressure of the heat engine. Keeping an entire thermocline at a working pressure requires large energy expenditures.

With pelletized thermal storage medium, hot-side solid thermal medium may reach temperatures over 600° C. and, if the heat exchanger vessel operates as direct contact between the working fluid and the solid thermal medium, the pressure may be over 100 bars. Similarly, cold-side thermal medium can go below −70° C. and be at or near vacuum state in the heat exchanger.

It may be desirable to divide a thermocline into an array of segments, each of which are separate pressure vessels. In this configuration, pressure vessels not in use may be kept at atmospheric pressure, thus saving energy. Only pressure vessels in use may be pressurized to a working pressure.

II. Illustrative Reversible Heat Engine

Systems and devices in which example embodiments may be implemented will now be described in greater detail. However, an example system may also be implemented in or take the form of other devices, without departing from the scope of the invention.

An aspect of the disclosure relates to thermal systems operating on thermal storage cycles. In some examples, the cycles allow electricity to be stored as heat (e.g., in the form of a temperature differential) and then converted back to mechanical work and ultimately electricity through the use of at least two pieces of turbomachinery (a compressor and a turbine), and a generator. The compressor consumes work and raises the temperature and pressure of a working fluid (WF). The turbine produces work and lowers the temperature and pressure of the working fluid. In some examples, more than one compressor and more than one turbine is used. In some cases, the system can include at least 1, at least 2, at least 3, at least 4, or at least 5 compressors. In some cases, the system can include at least 1, at least 2, at least 3, at least 4, or at least 5 turbines. The compressors may be arranged in series or in parallel. The turbines may be arranged in series or in parallel.

Figure 2:
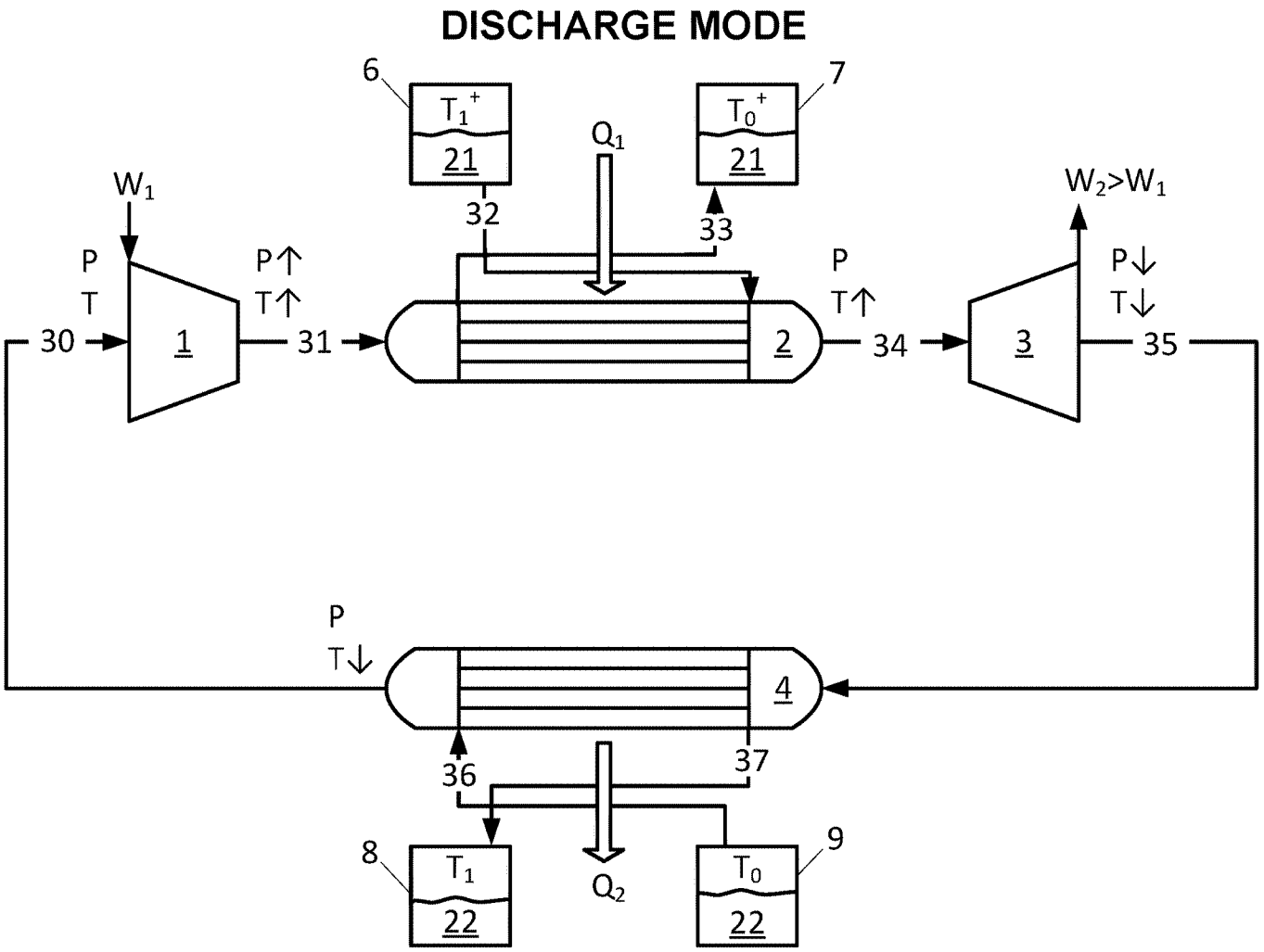
FIG. 2 is a schematic flow diagram of working fluid and heat storage media of a thermal system in a discharge/heat engine mode.

FIGS. 1 and 2 are schematic flow diagrams of working fluid and heat storage medium of an example thermal system in a charge/heat pump mode and in a discharge/heat engine mode, respectively. The system may be idealized for simplicity of explanation so that there are no losses (i.e., entropy generation) in either the turbomachinery or heat exchangers. The system can include a working fluid (e.g., argon gas) flowing in a closed cycle between a compressor 1, a hot side heat exchanger 2, a turbine 3 and a cold side heat exchanger 4. Fluid flow paths/directions for the working fluid (e.g., a gas), a hot side thermal storage (HTS) medium 21 (e.g., a low viscosity liquid or a solid medium) and a cold side thermal storage (CTS) medium 22 (e.g., a low viscosity liquid or a solid medium) are indicated by arrows. The heat exchangers 2 and 4 exchangers may incorporate, for example, conventional liquid-to-gas exchange for liquid thermal storage media (e.g., tube-and-shell exchangers or plate exchanger) and solid-to-gas exchange (e.g., direct contact) for solid thermal medium and may require pumping and/or conveyance mechanisms for the media.

Figure 3B:
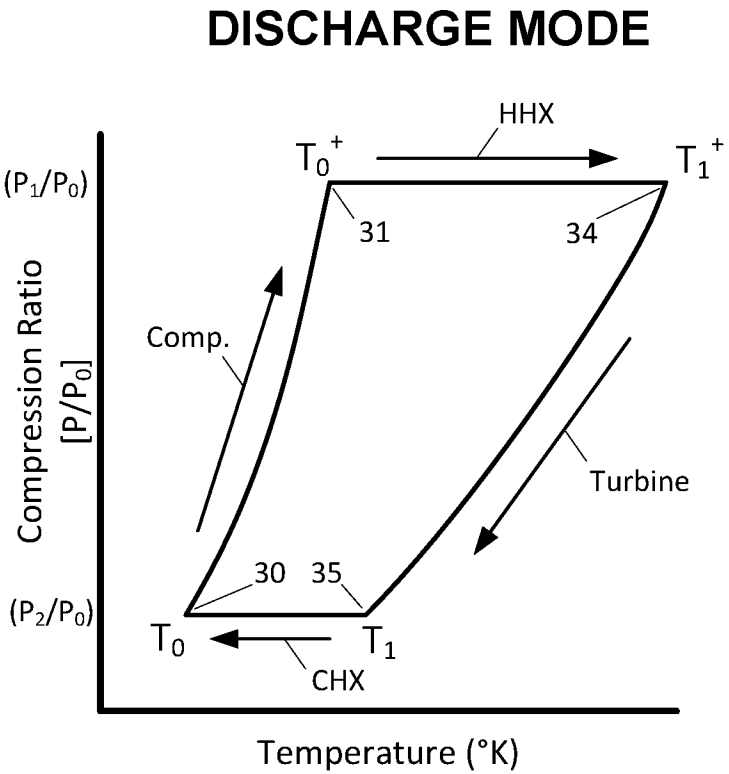
FIG. 3B is a schematic pressure and temperature diagram of the working fluid as it undergoes the discharge cycle in FIG. 2.
Figure 3A:
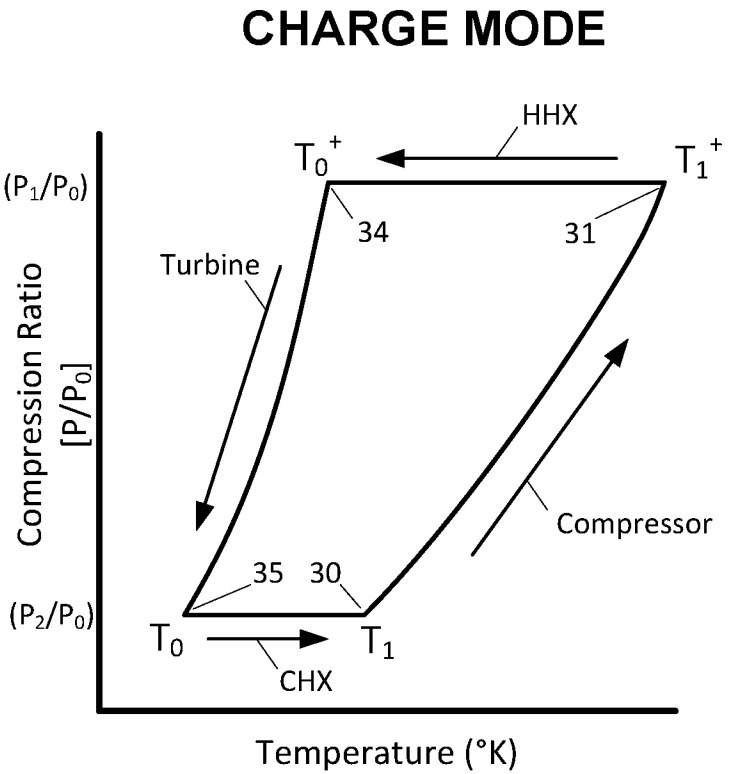
FIG. 3A is a schematic pressure and temperature diagram of the working fluid as it undergoes the charge cycle in FIG. 1.

FIGS. 3A and 3B are schematic pressure and temperature diagrams of the working fluid as it undergoes the charge cycles in FIGS. 1 and 2, respectively, once again simplified in the approximation of no entropy generation. Normalized pressure is shown on the y-axes and temperature is shown on the x-axes. The direction of processes taking place during the cycles is indicated with arrows, and the individual processes taking place in the compressor 1, the hot side CFX 2, the turbine 3 and the cold side CFX 4 are indicated on the diagram with their respective circled numerals.

The heat exchangers 2 and 4 can be configured as counter-flow heat exchangers (CFXs), where the working fluid flows in one direction and the substance it is exchanging heat with is flowing or moving or has a temperature gradient in the opposite direction. In an ideal counter-flow heat exchanger with correctly matched flows (i.e., balanced capacities or capacity flow rates or thermocline gradient), the temperatures of the working fluid and thermal storage medium flip (i.e., the counter-flow heat exchanger can have unity effectiveness).

The counter-flow heat exchangers 2 and 4 can be designed and/or operated to reduce entropy generation in the heat exchangers to negligible levels compared to entropy generation associated with other system components and/or processes (e.g., compressor and/or turbine entropy generation). In some cases, the system may be operated such that entropy generation in the system is minimized. For example, the system may be operated such that entropy generation associated with heat storage units is minimized. In some cases, a temperature difference between fluid or solid elements exchanging heat can be controlled during operation such that entropy generation in hot side and cold side heat storage units is minimized. In some instances, the entropy generated in the hot side and cold side heat storage units is negligible when compared to the entropy generated by the compressor, the turbine, or both the compressor and the turbine. In some instances, entropy generation associated with heat transfer in the heat exchangers 2 and 4 and/or entropy generation associated with operation of the hot side storage unit, the cold side storage unit or both the hot side and cold side storage units can be less than about 50%, less than about 25%, less than about 20%, less than about 15%, less than about 10%, less than about 5%, less than about 4%, less than about 3%, less than about 2%, or less than about 1% of the total entropy generated within the system (e.g., entropy generated by the compressor 1, the hot side heat exchanger 2, the turbine 3, the cold side heat exchanger 4 and/or other components described herein, such as, for example, a recuperator). For example, entropy generation can be reduced or minimized if the two substances exchanging heat do so at a local temperature differential $\Delta T \rightarrow 0$ (i.e., when the temperature difference between any two fluid or solid media elements that are in close thermal contact in the heat exchanger is small). In some examples, the temperature differential $\Delta T$ between any two fluid or solid media elements that are in close thermal contact may be less than about 300 Kelvin (K), less than about 200 K, less than about 100 K, less than about 75 K, less than about 50 K, less than about 40 K, less than about 30 K, less than about 20 K, less than about 10 K, less than about 5 K, less than about 3 K, less than about 2 K, or less than about 1 K. In another example, entropy generation associated with pressure drop can be reduced or minimized by suitable design. In some examples, the heat exchange process can take place at a constant or near-constant pressure. Alternatively, a non-negligible pressure drop may be experienced by the working fluid and/or one or more thermal storage media during passage through a heat exchanger. Pressure drop in heat exchangers may be controlled (e.g., reduced or minimized) through suitable heat exchanger design. In some examples, the pressure drop across each heat exchanger may be less than about 20% of inlet pressure, less than about 10% of inlet pressure, less than about 5% of inlet pressure, less than about 3% of inlet pressure, less than about 2% of inlet pressure, less than about 1% of inlet pressure, less than about 0.5% of inlet pressure, less than about 0.25% of inlet pressure, or less than about 0.1% of inlet pressure.

Upon entering the heat exchanger 2, the temperature of the working fluid can either increase (taking heat from the HTS medium 21, corresponding to the discharge mode in FIGS. 2 and 3B) or decrease (giving heat to the HTS medium 21, corresponding to the charge mode in FIGS. 1 and 3A), depending on the temperature of the HTS medium in the heat exchanger relative to the temperature of the working fluid. Similarly, upon entering the heat exchanger 4, the temperature of the working fluid can either increase (taking heat from the CTS medium 22, corresponding to the charge mode in FIGS. 1 and 3A) or decrease (giving heat to the CTS medium 22, corresponding to the discharge mode in FIGS. 2 and 3B), depending on the temperature of the CTS medium in the heat exchanger relative to the temperature of the working fluid.

As described in more detail with reference to the charge mode in FIGS. 1 and 3A, the heat addition process in the cold side CFX 4 can take place over a different range of temperatures than the heat removal process in the hot side CFX 2. Similarly, in the discharge mode in FIGS. 2 and 3B, the heat rejection process in the cold side CFX 4 can take place over a different range of temperatures than the heat addition process in the hot side CFX 2. At least a portion of the temperature ranges of the hot side and cold side heat exchange processes may overlap during charge, during discharge, or during both charge and discharge.

As used herein, the temperatures $T_0$, $T_1$, $T_0^+$ and $T_1^+$ are so named because $T_0^+$, $T_1^+$ are the temperatures achieved at the exit of a compressor with a given compression ratio r, adiabatic efficiency $\eta_c$ and inlet temperatures of $T_0$, $T_1$ respectively. The examples in FIGS. 1, 2, 3A and 3B can be idealized examples where $\eta_c=1$ and where adiabatic efficiency of the turbine $\eta_t$ also has the value $\eta_t=1$.

With reference to the charge mode shown in FIGS. 1 and 3A, the working fluid can enter the compressor 1 at position 30 at a pressure P and a temperature T (e.g., at $T_1$, $P_2$). As the working fluid passes through the compressor, work $W_1$ is consumed by the compressor to increase the pressure and temperature of the working fluid (e.g., to $T_1^+$, $P_1$), as indicated by P↑ and T↑ at position 31. In the charge mode, the temperature $T_1^+$ of the working fluid exiting the compressor and entering the hot side CFX 2 at position 31 is higher than the temperature of the HTS medium 21 entering the hot side CFX 2 at position 32 from a second hot side thermal storage tank 7 at a temperature $T_0^+$ (i.e., $T_0^+<T_1^+$). As these working fluid and thermal medium pass in thermal contact with each other in the heat exchanger, the working fluid's temperature decreases as it moves from position 31 to position 34, giving off heat $Q_1$ to the HTS medium, while the temperature of the HTS medium in turn increases as it moves from position 32 to position 33, absorbing heat Q1 from the working fluid. In an example, the working fluid exits the hot side CFX 2 at position 34 at the temperature $T_0^+$ and the HTS medium exits the hot side CFX 2 at position 33 into a first hot side thermal storage tank 6 at the temperature $T_1^+$. The heat exchange process can take place at a constant or near-constant pressure such that the working fluid exits the hot side CFX 2 at position 34 at a lower temperature but same pressure P1, as indicated by P and T↓ at position 34. Similarly, the temperature of the HTS medium 21 increases in the hot side CFX 2, while its pressure can remain constant or near-constant.

Upon exiting the hot side CFX 2 at position 34 (e.g., at $T_0^+$, $P_1$), the working fluid undergoes expansion in the turbine 3 before exiting the turbine at position 35. During the expansion, the pressure and temperature of the working fluid decrease (e.g., to $T_0$, $P_2$), as indicated by P↓ and T↓ at position 35. The magnitude of work $W_2$ generated by the turbine depends on the enthalpy of the working fluid entering the turbine and the degree of expansion. In the charge mode, heat is removed from the working fluid between positions 31 and 34 (in the hot side CFX 2) and the working fluid is expanded back to the pressure at which it initially entered the compressor at position 30 (e.g., $P_2$). The compression ratio (e.g., $P_1/P_2$) in the compressor 1 being equal to the expansion ratio in the turbine 3, and the enthalpy of the gas entering the turbine being lower than the enthalpy of the gas exiting the compressor, the work $W_2$ generated by the turbine 3 is smaller than the work $W_1$ consumed by the compressor 1 (i.e., $W_2<W_1$).

Because heat was taken out of the working fluid in the hot side CFX 2, the temperature $T_0$ at which the working fluid exits the turbine at position 35 is lower than the temperature $T_1$ at which the working fluid initially entered the compressor at position 30. To close the cycle (i.e., to return the pressure and temperature of the working fluid to their initial values $T_1$, $P_2$ at position 30), heat $Q_2$ is added to the working fluid from the CTS medium 22 in the cold side CFX 4 between positions 35 and 30 (i.e., between the turbine 3 and the compressor 1). In an example, the CTS medium 22 enters the cold side CFX 4 at position 36 from a first cold side thermal storage tank 8 at the temperature $T_1$ and exits the cold side CFX 4 at position 37 into a second cold side thermal storage tank 9 at the temperature $T_0$, while the working fluid enters the cold side CFX 4 at position 35 at the temperature $T_0$ and exits the cold side CFX 4 at position 30 at the temperature $T_1$. Again, the heat exchange process can take place at a constant or near-constant pressure such that the working fluid exits the cold side CFX 2 at position 30 at a higher temperature but same pressure $P_2$, as indicated by P and T↑ at position 30. Similarly, the temperature of the CTS medium 22 decreases in the cold side CFX 2, while its pressure can remain constant or near-constant.

During charge, the heat $Q_2$ is removed from the CTS medium and the heat $Q_1$ is added to the HTS medium, wherein $Q_1>Q_2$. A net amount of work $(W_1-W_2)$ is consumed, since the work $W_1$ used by the compressor is greater than the work $W_2$ generated by the turbine. A device that consumes work while moving heat from a cold body or thermal storage medium to a hot body or thermal storage medium is a heat pump; thus, the thermal system in the charge mode operates as a heat pump.

In an example, the discharge mode shown in FIGS. 2 and 3B can differ from the charge mode shown in FIGS. 1 and 3A in the temperatures of the thermal storage media being introduced into the heat exchangers. The temperature at which the HTS medium enters the hot side CFX 2 at position 32 is $T_1^+$ instead of $T_0^+$, and the temperature of the CTS medium entering the cold side CFX 4 at position 36 is $T_0$ instead of $T_1$. During discharge, the working fluid enters the compressor at position 30 at $T_0$ and $P_2$, exits the compressor at position 31 at $T_0^+<T_1^+$ and $P_1$, absorbs heat from the HTS medium in the hot side CFX 2, enters the turbine 3 at position 34 at $T_1^+$ and P1, exits the turbine at position 35 at $T_1>T_0$ and $P_2$, and finally rejects heat to the CTS medium in the cold side CFX 4, returning to its initial state at position 30 at $T_0$ and $P_2$.

The HTS medium at temperature $T_1^+$ can be stored in a first hot side thermal storage tank 6, the HTS medium at temperature $T_0^+$ can be stored in a second hot side thermal storage tank 7, the CTS medium at temperature $T_1$ can be stored in a first cold side thermal storage tank 8, and the CTS medium at temperature $T_0$ can be stored in a second cold side thermal storage tank 9 during both charge and discharge modes. In one implementation, the inlet temperature of the HTS medium at position 32 can be switched between $T_1^+$ and $T_0^+$ by switching between tanks 6 and 7, respectively. Similarly, the inlet temperature of the CTS medium at position 36 can be switched between $T_1$ and $T_0$ by switching between tanks 8 and 9, respectively. Switching between tanks can be achieved by including a valve or a system of valves, or a conveyance system or a group of conveyance systems, for switching connections between the hot side heat exchanger 2 and the hot side tanks 6 and 7, and/or between the cold side heat exchanger 4 and the cold side tanks 8 and 9 as needed for the charge and discharge modes. In some implementations, connections may be switched on the working fluid side instead, while the connections of storage tanks 6, 7, 8 and 9 to the heat exchangers 2 and 4 remain static. In some examples, flow paths and connections to the heat exchangers may depend on the design (e.g., shell-and-tube or direct-contact) of each heat exchanger. In some implementations, one or more valves or conveyance systems can be used to switch the direction of both the working fluid and the heat storage media through the counter-flow heat exchanger on charge and discharge. Such configurations may be used, for example, due to high thermal storage capacities of the heat exchanger component, to decrease or eliminate temperature transients, or a combination thereof. In some implementations, one or more valves or conveyance systems can be used to switch the direction of only the working fluid, while the direction of the HTS or CTS can be changed by changing the direction of pumping or conveyance, thereby maintaining the counter-flow configuration. In some implementations, different valve configurations or conveyance systems may be used for the HTS and the CTS. Further, any combination of the valve or conveyance configurations herein may be used. For example, the system may be configured to operate using different valve or conveyance configurations in different situations (e.g., depending on system operating conditions).

In the discharge mode shown in FIGS. 2 and 3B, the working fluid can enter the compressor 1 at position 30 at a pressure P and a temperature T (e.g., at $T_0$, $P_2$). As the working fluid passes through the compressor, work $W_1$ is consumed by the compressor to increase the pressure and temperature of the working fluid (e.g., to $T_0^+$, $P_1$), as indicated by P↑ and T↑ at position 31. In the discharge mode, the temperature $T_0$+ of the working fluid exiting the compressor and entering the hot side CFX 2 at position 31 is lower than the temperature of the HTS medium 21 entering the hot side CFX 2 at position 32 from a first hot side thermal storage tank 6 at a temperature $T_1^+$ (i.e., $T_0^+<T_1^+$). As these two fluids pass in thermal contact with each other in the heat exchanger, the working fluid's temperature increases as it moves from position 31 position 34, absorbing heat $Q_1$ from the HTS medium, while the temperature of the HTS medium in turn decreases as it moves from position 32 to position 33, giving off heat $Q_1$ to the working fluid. In an example, the working fluid exits the hot side CFX 2 at position 34 at the temperature $T_1^+$ and the HTS medium exits the hot side CFX 2 at position 33 into the second hot side thermal storage tank 7 at the temperature $T_0^+$. The heat exchange process can take place at a constant or near-constant pressure such that the working fluid exits the hot side CFX 2 at position 34 at a higher temperature but same pressure $P_1$, as indicated by P and T↑ at position 34.

Similarly, the temperature of the HTS medium 21 decreases in the hot side CFX 2, while its pressure can remain constant or near-constant.

Upon exiting the hot side CFX 2 at position 34 (e.g., at $T_1^+$, $P_1$), the working fluid undergoes expansion in the turbine 3 before exiting the turbine at position 35. During the expansion, the pressure and temperature of the working fluid decrease (e.g., to $T_1$, $P_2$), as indicated by P↓ and T↓ at position 35. The magnitude of work $W_2$ generated by the turbine depends on the enthalpy of the working fluid entering the turbine and the degree of expansion. In the discharge mode, heat is added to the working fluid between positions 31 and 34 (in the hot side CFX 2) and the working fluid is expanded back to the pressure at which it initially entered the compressor at position 30 (e.g., $P_2$). The compression ratio (e.g., $P_1/P_2$) in the compressor 1 being equal to the expansion ratio in the turbine 3, and the enthalpy of the gas entering the turbine being higher than the enthalpy of the gas exiting the compressor, the work $W_2$ generated by the turbine 3 is greater than the work $W_1$ consumed by the compressor 1 (i.e., $W_2>W_1$).

Because heat was added to the working fluid in the hot side CFX 2, the temperature $T_1$ at which the working fluid exits the turbine at position 35 is higher than the temperature $T_0$ at which the working fluid initially entered the compressor at position 30. To close the cycle (i.e., to return the pressure and temperature of the working fluid to their initial values $T_0$, $P_2$ at position 30), heat $Q_2$ is rejected by the working fluid to the CTS medium 22 in the cold side CFX 4 between positions 35 and 30 (i.e., between the turbine 3 and the compressor 1). The CTS medium 22 enters the cold side CFX 4 at position 36 from a second cold side thermal storage tank 9 at the temperature $T_0$ and exits the cold side CFX 4 at position 37 into a first cold side thermal storage tank 8 at the temperature $T_1$, while the working fluid enters the cold side CFX 4 at position 35 at the temperature $T_1$ and exits the cold side CFX 4 at position 30 at the temperature $T_0$. Again, the heat exchange process can take place at a constant or near-constant pressure such that the working fluid exits the cold side CFX 2 at position 30 at a higher temperature but same pressure $P_2$, as indicated by P and T↓ at position 30. Similarly, the temperature of the CTS medium 22 increases in the cold side CFX 2, while its pressure can remain constant or near-constant.

During discharge, the heat $Q_2$ is added to the CTS medium and the heat $Q_1$ is removed from the HTS medium, wherein $Q_1>Q_2$. A net amount of work $(W_2-W_1)$ is generated, since the work $W_1$ used by the compressor is smaller than the work $W_2$ generated by the turbine. A device that generates work while moving heat from a hot body or thermal storage medium to a cold body or thermal storage medium is a heat engine; thus, the thermal system in the discharge mode operates as a heat engine.

Another aspect of the disclosure is directed to thermal systems with regeneration/recuperation. In some situations, the terms regeneration and recuperation can be used interchangeably, although they may have different meanings. As used herein, the terms "recuperation" and "recuperator" generally refer to the presence of one or more additional heat exchangers where the working fluid exchanges heat with itself during different segments of a thermodynamic cycle through continuous heat exchange without intermediate thermal storage. As used herein, the terms "regeneration" and "regenerator" may be used to describe the same configuration as the terms "recuperation" and "recuperator." The roundtrip efficiency of thermal systems may be substantially improved if the allowable temperature ranges of the storage materials can be extended. In some implementations, this may be accomplished by choosing a material or medium on the cold side that can go to temperatures below 273 K (0° C.). For example, a CTS medium (e.g., hexane) with a low temperature limit of approximately $T_0$=179 K (−94° C.) may be used in a system with a molten salt or solid HTS medium. However, $T_0^+$ (i.e., the lowest temperature of the working fluid in the hot side heat exchanger) at some (e.g., modest) compression ratios may be below the freezing point of the molten salt, making the molten salt unviable as the HTS medium. In some implementations, this can be resolved by including a working fluid to working fluid (e.g., gas-gas) heat exchanger (also "recuperator" or "regenerator" herein) in the cycle.

Figure 4:
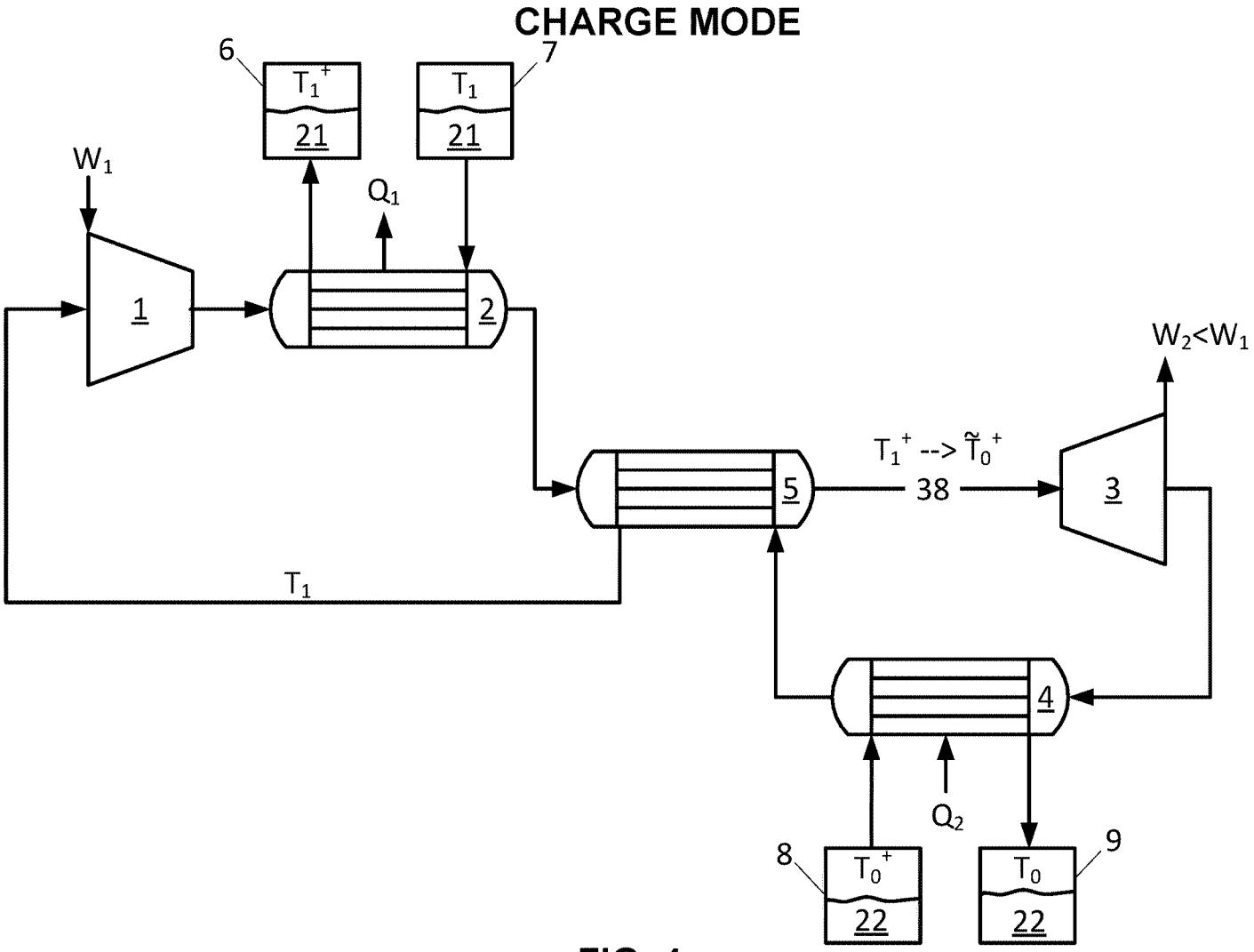
FIG. 4 is a schematic flow diagram of working fluid and heat storage media of a thermal system with a gas-gas heat exchanger for the working fluid in a charge/heat pump mode.

FIG. 4 is a schematic flow diagram of working fluid and heat storage media of a thermal system in a charge/heat pump mode with a gas-gas heat exchanger 5 for the working fluid. The use of the gas-gas heat exchanger can enable use of colder heat storage medium on the cold side of the system. As examples, the working fluid can be air, argon, or a mixture of primarily argon mixed with another gas such as helium. For example, the working fluid may comprise at least about 50% argon, at least about 60% argon, at least about 70% argon, at least about 80% argon, at least about 90% argon, or about 100% argon, with balance helium.

Figure 6B:
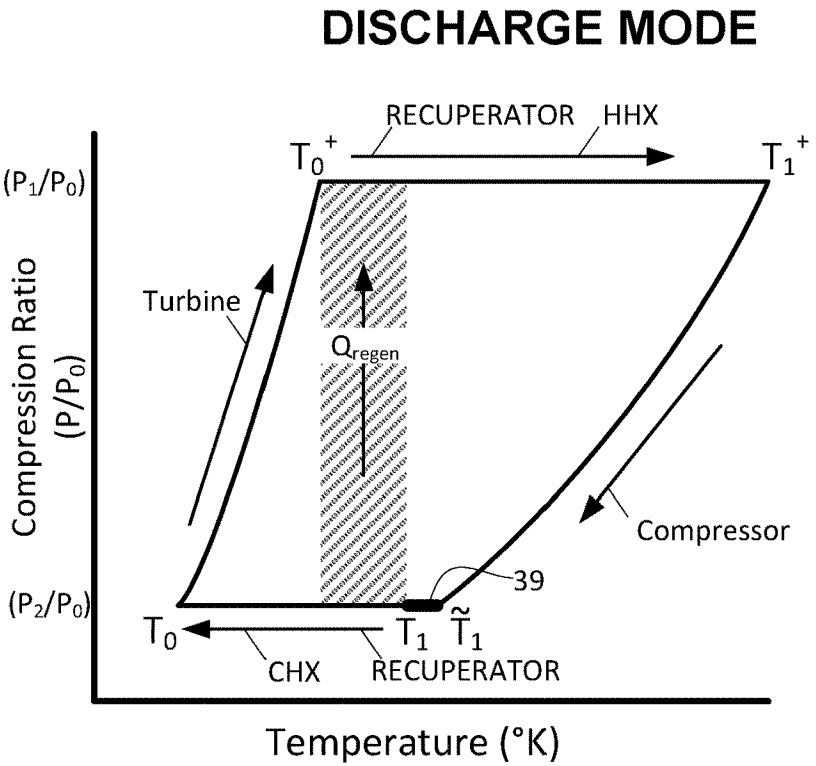
FIG. 6B is a schematic pressure and temperature diagram of the working fluid as it undergoes the discharge cycle in FIG. 5.
Figure 6A:
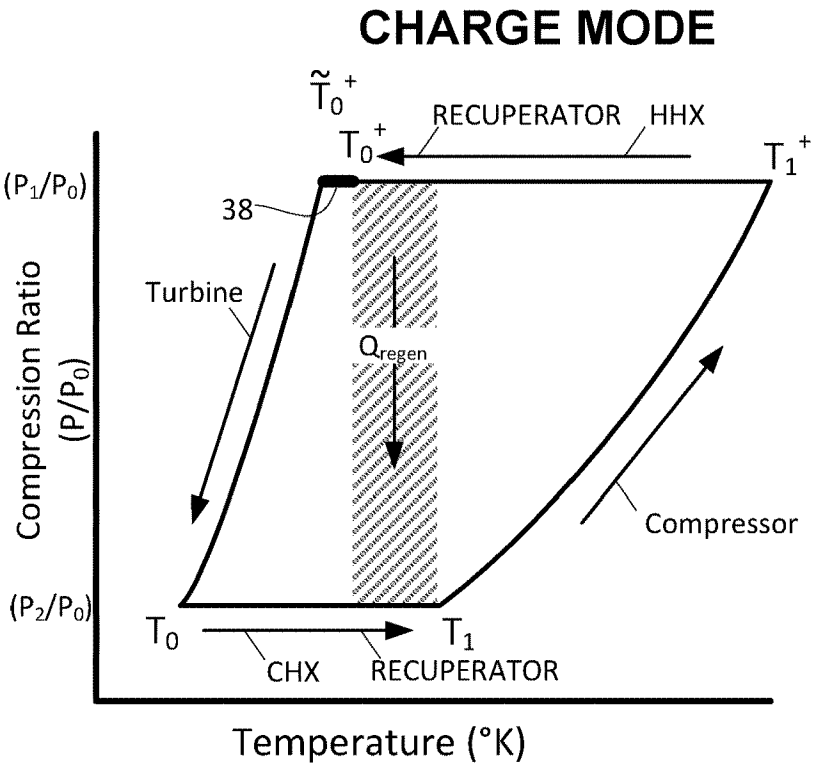
FIG. 6A is a schematic pressure and temperature diagram of the working fluid as it undergoes the charge cycle in FIG. 4.

FIG. 6A shows a heat storage charge cycle for the storage system in FIG. 4 with a cold side storage medium (e.g., liquid hexane or heptane) capable of going down to approximately to 179 K (−94° C.) and a molten salt or solid medium as the hot side storage, and $\eta_c$=0.9 and $\eta_t$=0.95. In some cases, the system can include more than four heat storage tanks.

In one implementation, during charge in FIGS. 4 and 6A, the working fluid enters the compressor at $T_1$ and $P_2$, exits the compressor at $T_1^+$ and $P_1$, rejects heat $Q_1$, to the HTS medium 21 in the hot side CFX 2, exiting the hot side CFX 2 at $T_1$ and $P_1$, rejects heat $Q_{recup}$ (also "$Q_{regen}$" herein, as shown, for example, in the accompanying drawings) to the cold (low pressure) side working fluid in the heat exchanger or recuperator 5, exits the recuperator 5 at $T_0^+$ and $P_1$, rejects heat to the environment (or other heat sink) in section 38 (e.g., a radiator), enters the turbine 3 at $\tilde{T}_0^+$ and $P_1$, exits the turbine at $T_0$ and $P_2$, absorbs heat $Q_2$ from the CTS medium 22 in the cold side CFX 4, exiting the cold side CFX 4 at $T_0^+$ and $P_2$, absorbs heat $Q_{recup}$ from the hot (high pressure) side working fluid in the heat exchanger or recuperator 5, and finally exits the recuperator 5 at $T_1$ and $P_2$, returning to its initial state before entering the compressor.

Figure 5:
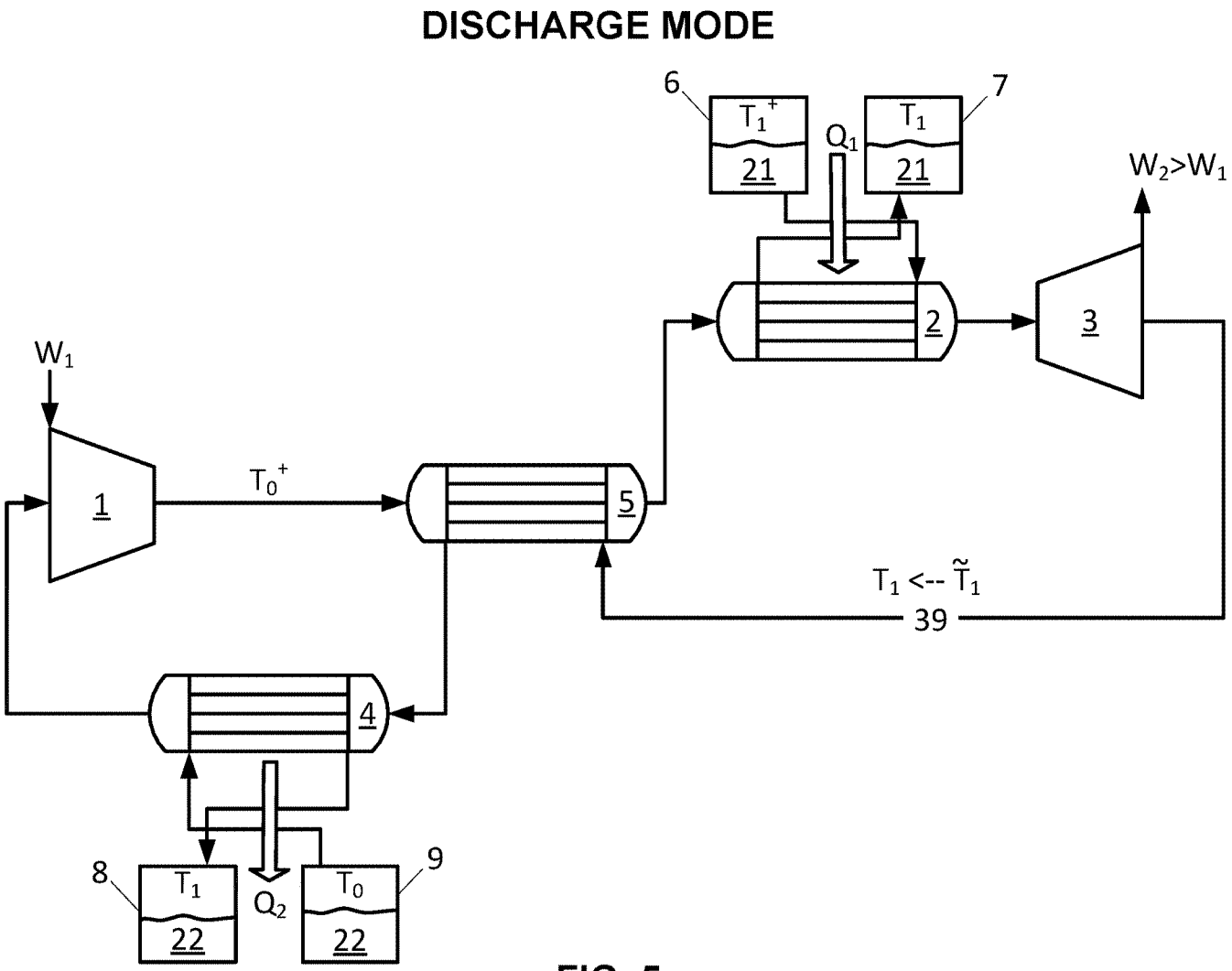
FIG. 5 is a schematic flow diagram of working fluid and heat storage media of a thermal system with a gas-gas heat exchanger for the working fluid in a discharge/heat engine mode.

FIG. 5 is a schematic flow diagram of working fluid and heat storage media of the thermal system in FIG. 4 in a discharge/heat engine mode. Again, the use of the gas-gas heat exchanger can enable use of colder heat storage fluid or solid medium (CTS) and/or colder working fluid on the cold side of the system.

FIG. 6B shows a heat storage discharge cycle for the storage system for the storage system in FIG. 5 with a cold side storage medium (e.g., liquid hexane) capable of going down to 179 K (−94° C.) and a molten salt or solid medium as the hot side storage, and ηc=0.9 and ηt=0.95.

During discharge in FIGS. 5 and 6B, the working fluid enters the compressor at $T_0$ and $P_2$, exits the compressor at $T_0^+$ and $P_1$, absorbs heat $Q_{recup}$ from the cold (low pressure) side working fluid in the heat exchanger or recuperator 5, exits the recuperator 5 at $T_1$ and $P_1$, absorbs heat $Q_1$ from the HTS medium 21 in the hot side CFX 2, exiting the hot side CFX 2 at $T_1^+$ and $P_1$, enters the turbine 3 at $\tilde{T}_1^+$ and $P_1$, exits the turbine at $\tilde{T}_1$ and $P_2$, rejects heat to the environment (or other heat sink) in section 39 (e.g., a radiator), rejects heat $Q_{recup}$ to the hot (high pressure) side working fluid in the heat exchanger or recuperator 5, enters the cold side CFX 4 at $T_0^+$ and $P_2$, rejects heat $Q_2$ to the CTS medium 22 in the cold side CFX 4, and finally exits the cold side CFX 4 at $T_0$ and $P_2$, returning to its initial state before entering the compressor.

In some examples, recuperation may enable the compression ratio to be reduced. In some cases, reducing the compression ratio may result in reduced compressor and turbine losses. In some cases, the compression ratio may be at least about 1.2, at least about 1.5, at least about 2, at least about 2.5, at least about 3, at least about 3.5, at least about 4, at least about 4.5, at least about 5, at least about 6, at least about 8, at least about 10, at least about 15, at least about 20, at least about 30, or more.

In some cases, $T_0$ may be at least about 30 K, at least about 50 K, at least about 80 K, at least about 100 K, at least about 120 K, at least about 140 K, at least about 160 K, at least about 180 K, at least about 200 K, at least about 220 K, at least about 240 K, at least about 260 K, or at least about 280 K. In some cases, $T_0^+$ may be at least about 220 K, at least about 240 K, at least about 260 K, at least about 280 K, at least about 300 K, at least about 320 K, at least about 340 K, at least about 360 K, at least about 380 K, at least about 400 K, or more. In some cases, the temperatures $T_0$ and $T_0^+$ can be constrained by the ability to reject excess heat to the environment at ambient temperature due to inefficiencies in components such as turbomachinery. In some cases, the temperatures $T_0$ and $T_0^+$ can be constrained by the operating temperatures of the CTS (e.g., a phase transition temperature). In some cases, the temperatures $T_0$ and $T_0^+$ can be constrained by the compression ratio being used. Any description of the temperatures $T_0$ and/or $T_0^+$ herein may apply to any system or method of the disclosure.

In some cases, $T_1$ may be at least about 350K, at least about 400 K, at least about 440 K, at least about 480 K, at least about 520 K, at least about 560 K, at least about 600 K, at least about 640 K, at least about 680 K, at least about 720 K, at least about 760 K, at least about 800 K, at least about 840 K, at least about 880 K, at least about 920 K, at least about 960 K, at least about 1000 K, at least about 1100 K, at least about 1200 K, at least about 1300 K, at least about 1400 K, or more. In some cases, $T_1^+$ may be at least about 480 K, at least about 520 K, at least about 560 K, at least about 600 K, at least about 640 K, at least about 680 K, at least about 720 K, at least about 760 K, at least about 800 K, at least about 840 K, at least about 880 K, at least about 920 K, at least about 960 K, at least about 1000 K, at least about 1100 K, at least about 1200 K, at least about 1300 K, at least about 1400 K, at least about 1500 K, at least about 1600 K, at least about 1700 K, or more. In some cases, the temperatures $T_1$ and $T_1^+$ can be constrained by the operating temperatures of the HTS. In some cases, the temperatures $T_1$ and $T_1^+$ can be constrained by the thermal limits of the metals and materials being used in the system. For example, a conventional solar salt can have a recommended temperature range of approximately 560-840 K. Various system improvements, such as, for example, increased round-trip efficiency, increased power and increased storage capacity may be realized as available materials, metallurgy and storage materials improve over time and enable different temperature ranges to be achieved. Any description of the temperatures $T_1$ and/or $T_1^+$ herein may apply to any system or method of the disclosure.

In some cases, the round-trip efficiency $\eta_{store}$ (e.g., electricity storage efficiency) with and/or without recuperation can be at least about 5%, at least about 10%, at least about 15%, at least about 20%, at least about 25%, at least about 30%, at least about 35%, at least about 40%, at least about 45%, at least about 50%, at least about 55%, at least about 60%, at least about 65%, at least about 70%, at least about 75%, at least about 80%, at least about 85%, at least about 90%, or at least about 95%.

In some implementations, at least a portion of heat transfer in the system (e.g., heat transfer to and from the working fluid) during a charge and/or discharge cycle includes heat transfer with the environment (e.g., heat transfer in sections 38 and 39). The remainder of the heat transfer in the system can occur through thermal communication with thermal storage media (e.g., thermal storage media 21 and 22), through heat transfer in the recuperator 5 and/or through various heat transfer processes within system boundaries (i.e., not with the surrounding environment). In some examples, the environment may refer to gaseous or liquid reservoirs surrounding the system (e.g., air, water), any system or media capable of exchanging thermal energy with the system (e.g., another thermodynamic cycle or system, heating/cooling systems, etc.), or any combination thereof. In some examples, heat transferred through thermal communication with the heat storage media can be at least about 25%, at least about 50%, at least about 60%, at least about 70%, at least about 80%, or at least about 90% of all heat transferred in the system. In some examples, heat transferred through heat transfer in the recuperator can be at least about 5%, at least about 10%, at least about 15%, at least about 20%, at least about 25%, at least about 50%, or at least about 75% of all heat transferred in the system. In some examples, heat transferred through thermal communication with the heat storage media and through heat transfer in the recuperator can be at least about 25%, at least about 50%, at least about 60%, at least about 70%, at least about 80%, at least about 90%, or even about 100% of all heat transferred in the system. In some examples, heat transferred through heat transfer with the environment can be less than about 5%, less than about 10%, less than about 15%, less than about 20%, less than about 30%, less than about 40%, less than about 50%, less than about 60%, less than about 70%, less than about 80%, less than about 90%, less than about 100%, or even 100% of all heat transferred in the system. In some implementations, all heat transfer in the system may be with the thermal storage media (e.g., the CTS and HTS media), and only the thermal storage media may conduct heat transfer with the environment.

Thermal cycles of the disclosure (e.g., the cycles in FIGS. 4 and 5) may be implemented through various configurations of pipes and valves for transporting the working fluid between the turbomachinery and the heat exchangers. In some implementations, a valving system may be used such that the different cycles of the system can be interchanged while maintaining the same or nearly the same temperature profile across at least one, across a subset or across all of counter-flow heat exchangers in the system. For example, the valving may be configured such that the working fluid can pass through the heat exchangers in opposite flow directions on charge and discharge and flow or conveyance directions of the HTS and CTS media are reversed by reversing the direction of the pumps or conveyance systems.

In some implementations, the system may be set up to enable switching between different cycles. Such a configuration may be advantageous as it may reuse at least a portion, or a substantial portion, or a majority, of the same piping and/or connections for the working fluid in both the charging and discharging modes. While the working fluid may change direction between charge and discharge, the temperature profile of the heat exchangers can be kept constant, partially constant, or substantially or fully constant, by changing the direction in which the HTS medium and the CTS medium are pumped or conveyed when switching from charge to discharge and vice-versa, and/or by matching the heat fluxes of the working fluid, the HTS medium and the CTS medium appropriately.

III. Illustrative Thermoclines Arrays in a Brayton Cycle Engine

Figure 7:
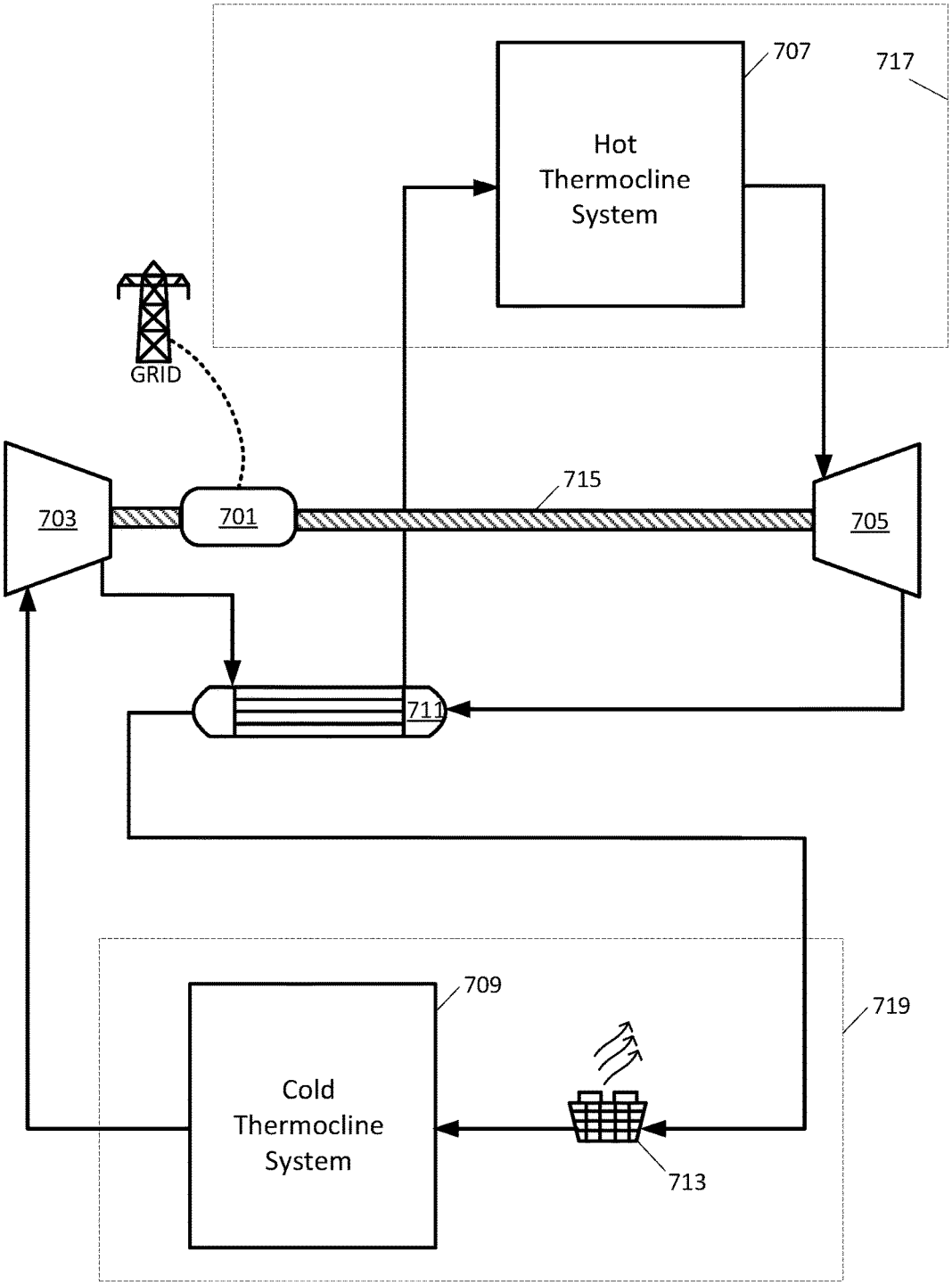
FIG. 7 illustrates a schematic flow diagram according to an example embodiment.

FIG. 7 illustrates a Brayton cycle heat engine configured to generate electrical power and supply such power to an electrical grid. The heat engine may be reversible (i.e., operate as a heat pump) and may take the form of other heat engines and/or reversible heat engines describe herein and may include additional or alternative components than those shown in the illustration. The heat engine may include a generator/motor 701 that may generate electricity or use electricity to operate a compressor 703. The generator/motor 701 may be mechanically coupled to the compressor 703 and a turbine 705. The compressor 703 and the turbine 705 may be coupled to the generator/motor 701 via one or more shafts 715. Alternatively, the compressor 703 and the turbine 705 may be coupled to the generator/motor 701 via one or more gearboxes and/or shafts. The heat engine may use mechanical work to store heat and/or may provide mechanical work from stored heat. The heat engine may have a hot side 717 and a cold side 719.

In one embodiment, the heat engine may include a hot-side thermocline system 707 comprising a plurality of pressure vessels (see FIG. 9) coupled between the compressor 703 and the turbine 705 on the hot side 717. The hot-side thermocline system 707 may act as a direct-contact heat exchanger, where a working fluid is in direct contact with a solid thermal medium and at greater than atmospheric pressure. A recuperative heat exchanger 711 may be disposed in the working fluid path between the compressor 703 and the hot-side thermocline system 707. With the use of solid thermal medium, which may be effective across a wide temperature range, it may be possible to reduce or eliminate the use of a recuperative heat exchanger.

A cold-side thermocline system 709 comprising a plurality of pressure vessels (see FIG. 9) may be coupled between the turbine 705 and the compressor 703 on the cold side 719. The cold-side thermocline system 709 may act as a direct-contact heat exchanger, where a working fluid is in direct contact with a solid thermal medium and at less than atmospheric pressure. The recuperative heat exchanger 711 may be disposed in the working fluid path between the turbine 705 and the cold-side thermocline system 709, such that a working fluid stream downstream of the turbine 705 is in thermal contact with a working fluid stream downstream of the compressor 703.

The plurality of pressure vessels in the hot-side thermocline system 707 and the plurality of pressure vessels in the cold-side thermocline system 709 are preferably insulated pressure vessels. (See FIG. 8 for further description.) As used herein, a pressure vessel is intended to refer to a vessel or containment area that can operate at either or both above atmospheric pressure (e.g., 1 to 5 bar, 5 to 30 bar, 30 to 100 bar, or greater) and/or below atmospheric pressure (e.g., $1\times10^5$ to $3\times10^3$ Pa, $3\times10^3$ to $1\times10^1$ Pa, $1\times10^1$ to $1\times10^{-7}$ Pa, or less). They may be insulated to prevent or reduce transmission of heat contained within the vessel to the external environment. They may further be sealed to maintain the pressure of incoming working fluid that may be substantially above or below atmospheric pressure and to maintain a substantially isobaric environment where the working fluid may directly contact the solid thermal medium. The pressure vessels in thermocline systems 707 and 709 may include one or more inlets for receiving the working fluid at non-atmospheric pressure from the Brayton cycle system, and one or more outlets for dispatching the working fluid at non-atmospheric pressure to the Brayton cycle system. The inlets and outlets may be one or more apertures through the exterior walls of the pressure vessels in thermocline systems 707 and 709 and that are connected to the respective working fluid streams and sealed from the atmosphere.

The pressure vessels in thermocline systems 707 and 709 each preferably contain a solid thermal medium. The solid thermal medium may have a structure with porosity sufficient to allow the working fluid to flow through the solid thermal medium. Each of the pressure vessels may have one or more pressure sealed access ports to load or unload solid thermal medium for thermal charging, maintenance, or other access requirements.

The heat engine illustrated in FIG. 7 may also have fluid paths configured to allow it to operate without a recuperator (as in FIG. 2) and/or to operate reversibly and function to store excess electrical energy in the form of thermal energy, similar to the cycle shown in FIG. 4 or FIG. 1 without a recuperator), where the hot side heat exchanger 2 and associated tanks 6 and 7 and HTS medium 21 are replaced with thermocline 707 and the cold side heat exchanger 4 and associated tanks 8 and 9 and CTS medium 22 are replaced with thermocline 709, and the fluid flow paths are as indicated in FIG. 1, 2 or 4. Due to inefficiencies likely present in the system, excess heat may need to be rejected in the discharge or charge cycles. Heat rejection devices may be inserted into the fluid paths of the described embodiments without departing from the claimed subject matter.

As an example embodiment only, in a discharge cycle, a heat rejection device 713, such as a cooling tower, may be disposed in, or coupled to, the working fluid stream between the turbine 705 and the cold-side thermocline vessel 709. The heat rejection device 713 may eject heat from the system, where the heat may be carried into the heat rejection device 713 by the working fluid and ejected to the atmosphere or other heat sink.

IV. Illustrative Thermocline Arrays

Figure 8:
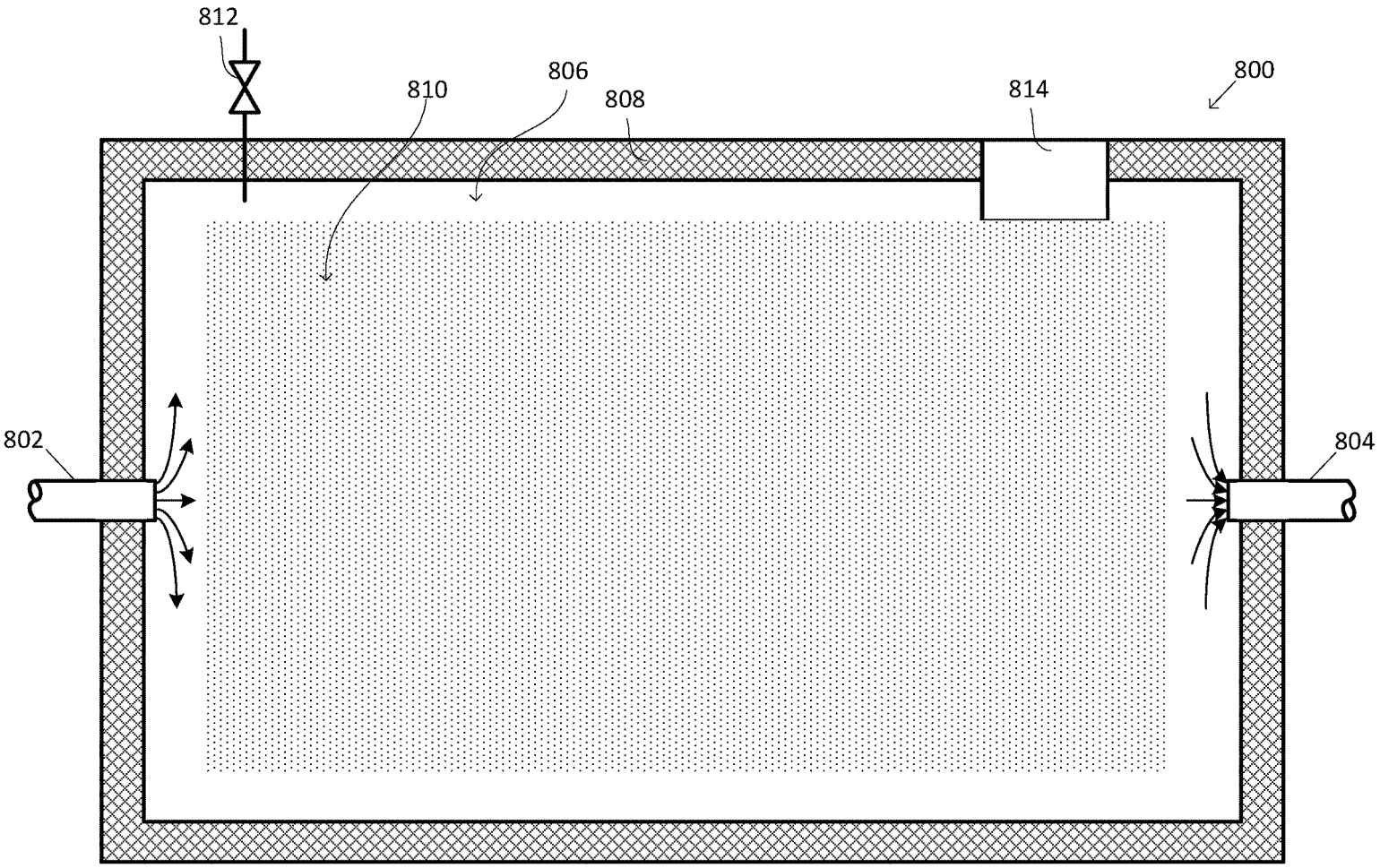
FIG. 8 illustrates a schematic arrangement, in cut-away view, of a thermocline pressure vessel according to an example embodiment.

FIG. 8 illustrates a schematic arrangement, in cut-away view, of a pressure vessel 800 according to an example embodiment. The pressure vessel 800 may include an inlet 802 for working fluid from a Brayton cycle system and an outlet 804 for working fluid to the Brayton cycle system. The inlet 802 and outlet 804 may each be simple pipe ports with an opening into an interior volume 806 of the pressure vessel 800 and/or they may include more complex structures such as distribution plenums that connect to external piping containing the working fluid.

The pressure vessel 800 may take various forms sufficient to withstand the pressure of the working fluid and to prevent or reduce heat transfer between the solid thermal medium, the external environment, and other pressure vessels. For example, the pressure vessel 800 may be a container with insulated walls 808. The insulated walls 808 may include one or more materials designed to withstand pressure and/or to minimize heat transfer. For example, the walls 808 may include internal insulation, an interior surface of refractory material, a structural steel core, and an external insulation and/or protective material capable of withstanding long-term environmental exposure. Pressure sealed access ports may be included within the walls.

The pressure vessel 800 may also comprise a solid thermal storage medium 810 located within the interior volume 806. The solid thermal medium 810 may have a structure with porosity sufficient to allow the working fluid to flow through the solid thermal medium 810. The solid thermal medium 810 may take many forms, including but not limited to, dirt, rock, gravel, sand, clay, metal, metal oxide, refractory material, refractory metal, ceramic, cement, alumina, silica, magnesia, zirconia, silicon carbide, titanium carbide, tantalum carbide, chromium carbide, niobium carbide, zirconium carbide, molybdenum disilicide, calcium oxide, chromite, dolomite, magnesite, quartzite, aluminum silicate, tungsten, molybdenum, niobium, tantalum, rhenium, beryllium, and combinations thereof. Solid thermal medium 810 for use in cold systems may further include water ice, and/or other solid forms of common room temperature liquids. Preferably, the solid medium 810 is structurally stable at high or low temperature, of uniform shape and/or size, and shaped such that a bolus of solid medium includes gaps to allow a working fluid to flow through the bolus. For example, for refractory materials it may be preferable to utilize larges slabs, stackable bricks, platonic solids, spheres, cylinders, or other shapes that can be stacked and/or arranged to allow gaps between individual units of the solid thermal medium 810. For metal, metal oxides, or ceramics it may be preferable to use those shapes or fabrics or meshes that consist entirely or partially of the metal, metal oxide, or ceramic, where the fabric or mesh has a porosity sufficient to allow passage of a working fluid through the solid medium.

The pressure vessel 800 may also comprise an equalization valve 812 configured to allow the pressure of each pressure vessel interior volume 806 that is isolated from the working fluid to equilibrate to a storage pressure.

Each pressure vessel 800 may further comprise an access port 814 configured to permit loading of solid thermal storage medium 810 into and out of the pressure vessel interior volume 806.

Figure 9:
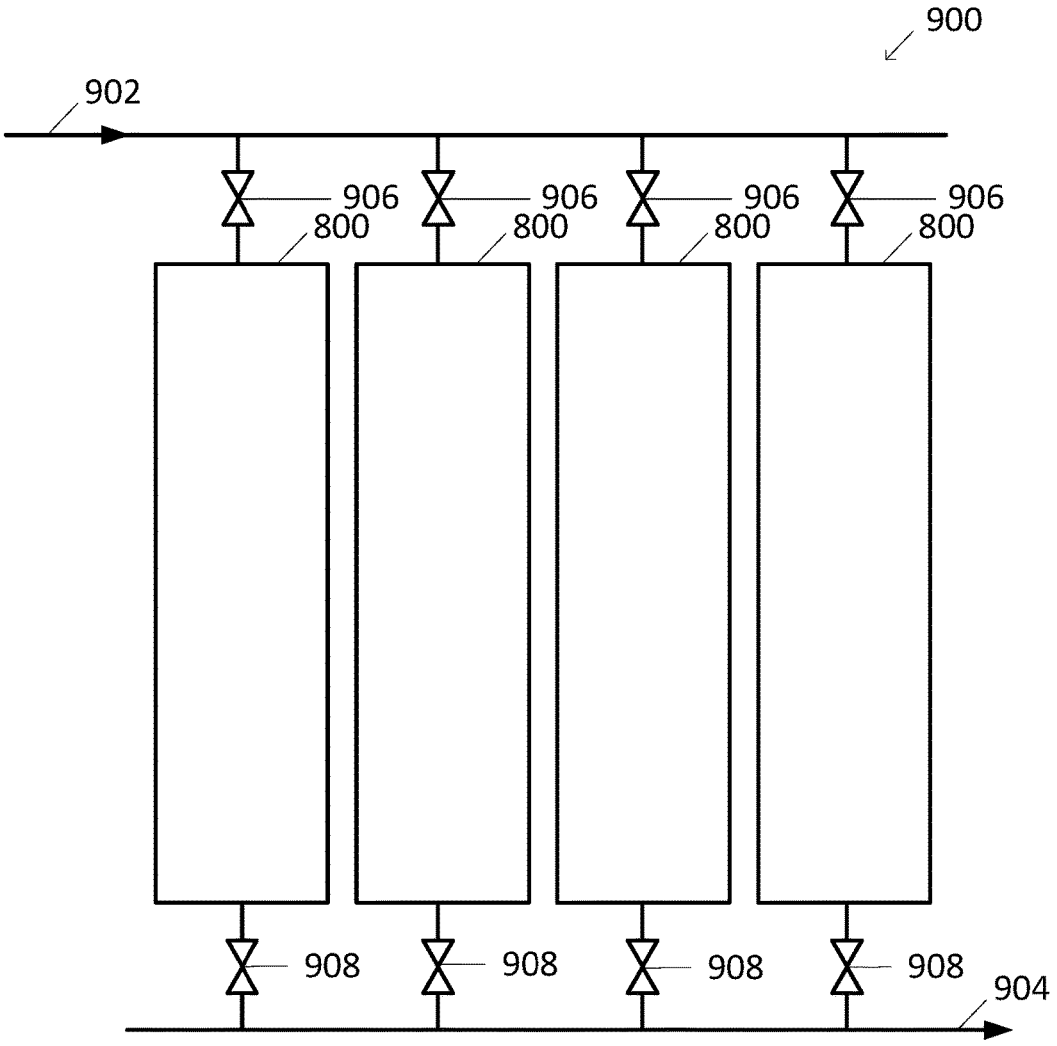
FIG. 9 illustrates a thermocline array system, according to an example embodiment.

FIG. 9 illustrates an example embodiment of a thermocline array system 900. Thermocline array system 900 could be used as a hot-side thermocline system or a cold-side thermocline system in a Brayton cycle, such as the one illustrated in FIG. 7, or as a substitution for the heat exchanger systems in other Figures herein, or for use in other open or closed thermodynamic cycle systems. Thermocline array system 900 may comprise inlet fluid path 902 and an outlet fluid path 904. The inlet fluid path 902 may receive a working fluid at a working pressure from a Brayton cycle system. The working pressure may not be atmospheric pressure. In some embodiments, the working pressure may be greater than atmospheric pressure. In other embodiments, the working pressure may be below atmospheric pressure. The working pressure of the working fluid in the inlet fluid path 902 may be measured by a pressure sensor on or near the inlet fluid path 902. The measured working pressure of the working fluid in the inlet fluid path 902 may be transmitted to a controller that may control one or more valves described herein.

The outlet fluid path 904 may return the working fluid to the Brayton cycle system. Thermocline array system 900 may also comprise a plurality of pressure vessels 800, as illustrated in FIG. 8. Each pressure vessel 800 may comprise an inlet valve 906 configured to connect or isolate the interior volume 806 to or from the inlet fluid path 902 and an outlet valve 908 configured to connect or isolate the interior volume 806 to or from the outlet fluid path 904.

At least one pressure vessel interior volume 806 may be connected to the inlet fluid path 902 and the outlet fluid path 904. At least one pressure vessel interior volume 806 may be isolated from the inlet fluid path 902 and the outlet fluid path 904. Such a configuration allows for non-pressurized storage of the solid thermal medium 810, thus reducing energy costs.

Each pressure vessel interior volume 806 connected to the inlet fluid path 902 and the outlet fluid path 904 may be at the working pressure. The working pressure may be up to about 3 bar, 10 bar, 30 bar, 50 bar, 100 bar, or higher, or may be at or near vacuum pressure. Each pressure vessel interior volume 806 isolated from the inlet fluid path 902 and the outlet fluid path 904 may be at a storage pressure that is not the working pressure. The storage pressure may be atmospheric pressure, which may reduce the chance of explosion or leakage. The ratio of the working pressure to the storage pressure may be at least 3:1. The storage pressure of a given pressure vessel may be measured by a pressure sensor in communication with the pressure vessel interior volume 806. The measured storage pressure may be transmitted to a controller that may control one or more valves described herein.

The solid thermal medium 810 in each pressure vessel interior volume 806 that is connected to the inlet fluid path 902 and the outlet fluid path 904 may transfer thermal energy with the working fluid. For example, when operating in a Brayton cycle discharge mode, the working fluid may transfer thermal energy to, or receive thermal energy from, the solid thermal medium 810 in each pressure interior volume 806 that is connected to the inlet fluid path 902 and the outlet fluid path 904.

The inlet fluid path 902 and/or outlet fluid path 904 may be coupled to a working fluid path downstream of a compressor and upstream of a turbine in a Brayton cycle system. Alternatively, the inlet fluid path 902 and/or outlet fluid path 904 may be coupled to a working fluid path downstream of a turbine and upstream of a compressor in a Brayton cycle system.

As arranged, the thermocline array system 900 may reduce the flow path of the working fluid in a Brayton cycle, thus reducing pressure drop and/or resistance as a compared to a large single thermocline.

V. Illustrative Methods of Operating Brayton Cycles with Thermal Arrays

Figure 10:
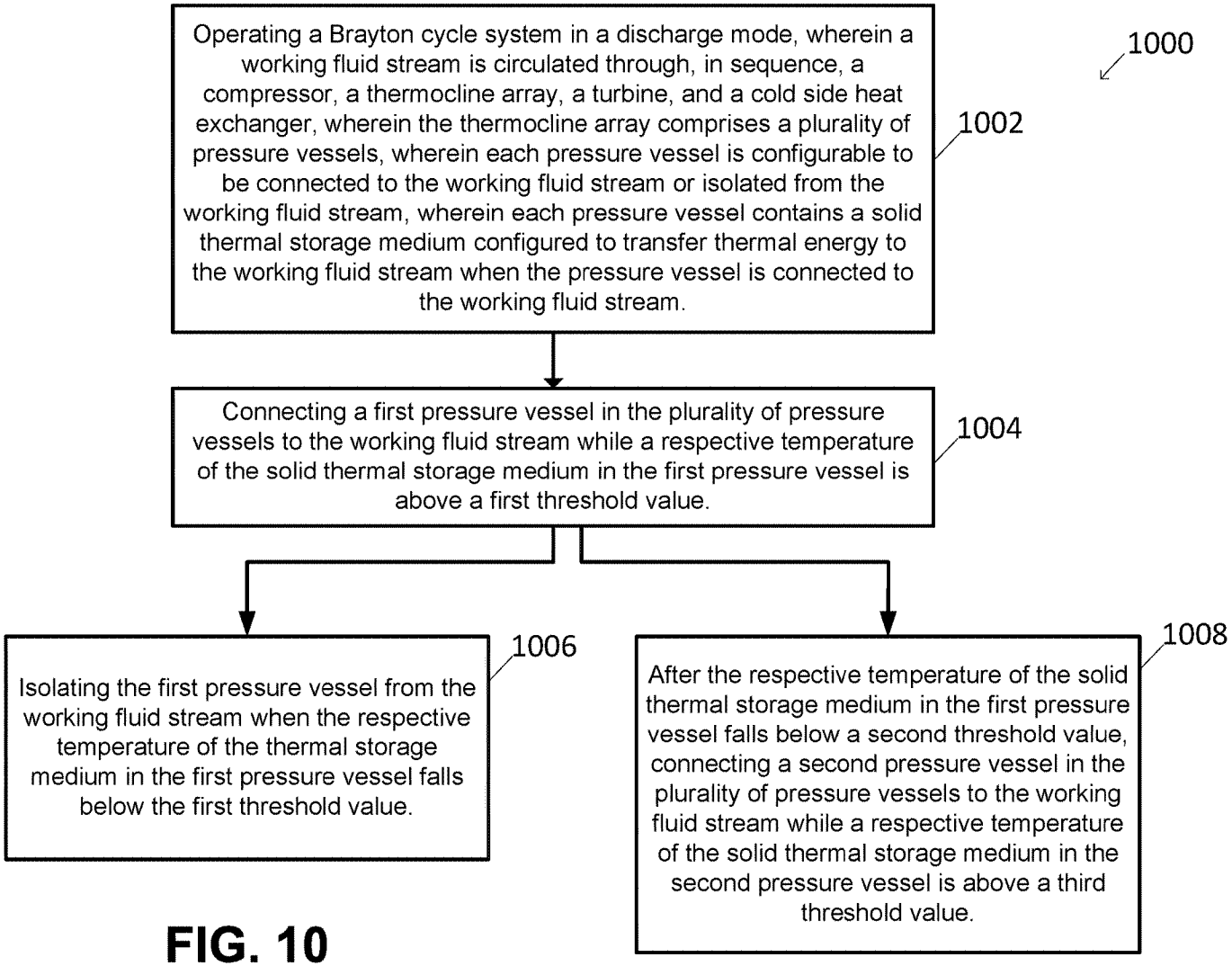
FIG. 10 illustrates a method of operating a Brayton cycle with a thermocline array in a discharge mode according to an example embodiment.

FIG. 10 illustrates an example method 1000. At step 1002, the method 1000 may include operating a Brayton cycle system in a discharge mode, wherein a working fluid stream is circulated through, in sequence, a compressor, a thermocline array, a turbine, and a cold side heat exchanger, wherein the thermocline array comprises a plurality of pressure vessels, wherein each pressure vessel is configurable to be connected to the working fluid stream or isolated from the working fluid stream, wherein each pressure vessel contains a solid thermal storage medium configured to transfer thermal energy to the working fluid stream when the pressure vessel is connected to the working fluid stream. At step 1004, the method 1000 may include connecting a first pressure vessel in the plurality of pressure vessels to the working fluid stream while a respective temperature of the solid thermal storage medium in the first pressure vessel is above a first threshold value (e.g., a minimum operating temperature). For example, the first threshold value may be some value between the values $T_0^+$ and $T_1^+$ described with respect to hot side thermal fluids above. The respective temperature of the solid thermal storage medium in a given pressure vessel may be measured by a temperature sensor in the pressure vessel. The measured temperature may be transmitted to a controller that may be configured to connect or isolate the pressure vessel to or from the working fluid stream. At step 1006, the method 1000 may include isolating the first pressure vessel from the working fluid stream when the respective temperature of the thermal storage medium in the first pressure vessel falls below the first threshold value (e.g., the minimum operating temperature). At step 1008, the method may include, after the respective temperature of the solid thermal storage medium in the first pressure vessel falls below a second threshold value (e.g., a minimum operating temperature or the minimum operating temperature plus an operating margin), connecting a second pressure vessel in the plurality of pressure vessels to the working fluid stream while a respective temperature of the solid thermal storage medium in the second pressure vessel is above a third threshold value (e.g., a minimum operating temperature for the second pressure vessel).

In pressure vessels used in hot-side thermocline systems, the temperature of the thermal storage medium may range from about 290° C. to about 565° C. In pressure vessels used in cold-side thermocline systems, the temperature of the thermal storage medium may range from about −60° C. to about 35° C.

In some embodiments, the first threshold value and the second threshold value may be the same value. In such embodiments, when temperature of the thermal storage medium in the first pressure vessel falls below this value, the first pressure vessel is isolated from the working fluid stream and the second pressure vessel is connected to the working fluid stream. In other embodiments, the first threshold value and the second threshold value may be different values, for example, the second threshold value may be greater than the first threshold value. In such embodiments, the first pressure vessel may remain connected to the working fluid stream when the second pressure vessel is connected to the working fluid stream. In another embodiment, the first threshold value, the second threshold value, and the third threshold value may be the same value. As examples, the first threshold value may be based on a minimum operating temperature (e.g., between $T_0^+$ and $T_1^+$) and the second threshold value may be based on a minimum operating temperature plus an operating margin.

Figure 11:
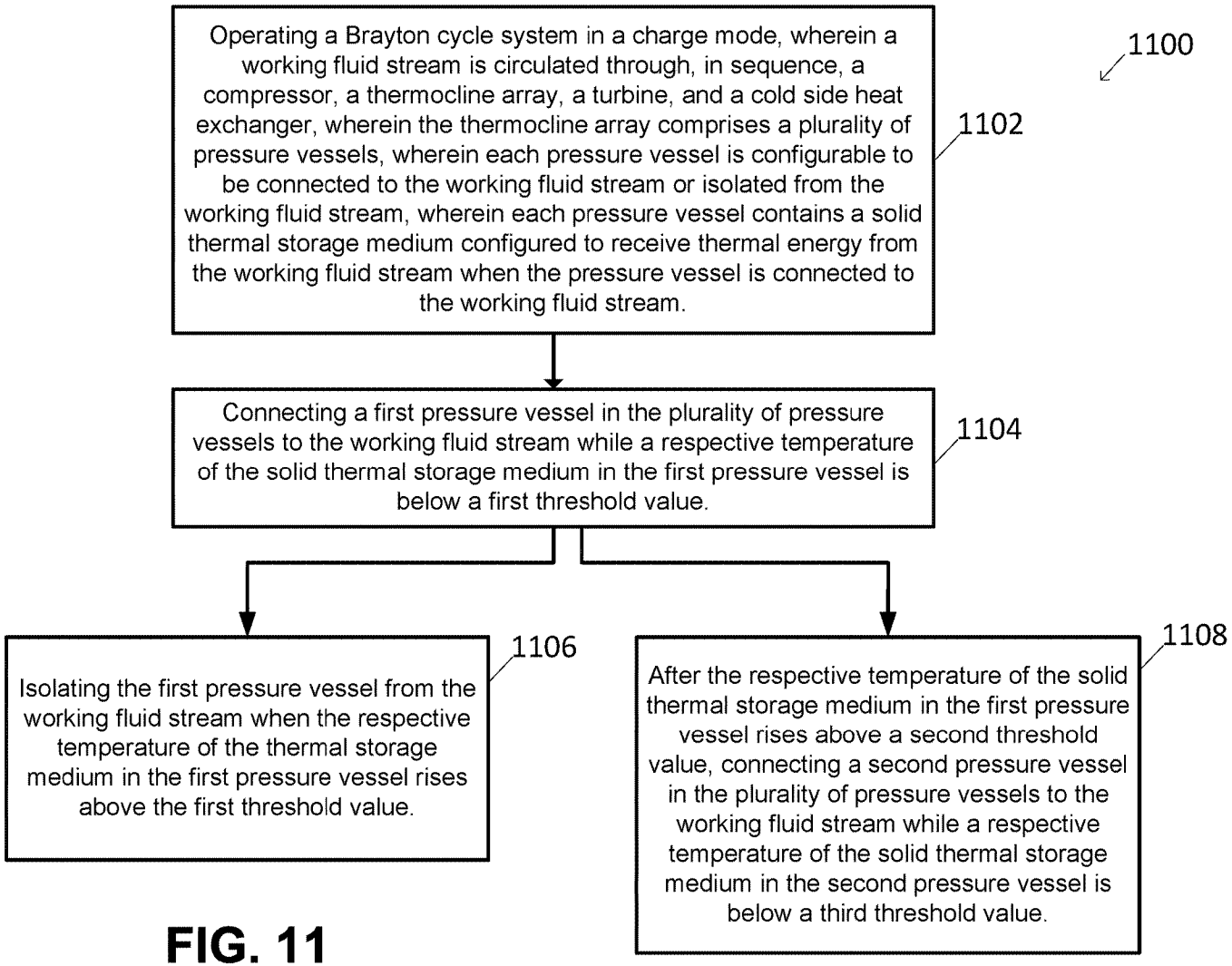
FIG. 11 illustrate a method of operating a Brayton cycle with a thermocline array in charge mode according to an example embodiment.

FIG. 11 illustrates an example method 1100. At step 1102, the method 1100 may include operating a Brayton cycle system in a charge mode, wherein a working fluid stream is circulated through, in sequence, a compressor, a thermocline array, a turbine, and a cold side heat exchanger, wherein the thermocline array comprises a plurality of pressure vessels, wherein each pressure vessel is configurable to be connected to the working fluid stream or isolated from the working fluid stream, wherein each pressure vessel contains a solid thermal storage medium configured to receive thermal energy from the working fluid stream when the pressure vessel is connected to the working fluid stream. At step 1104, the method 1100 may include connecting a first pressure vessel in the plurality of pressure vessels to the working fluid stream while a respective temperature of the solid thermal storage medium in the first pressure vessel is below a first threshold value (e.g., a maximum operating temperature). For example, the first threshold value may be some value between the values $T_0^+$ and $T_1^+$ described with respect to hot side thermal fluids above. The respective temperature of the solid thermal storage medium in a given pressure vessel may be measured by a temperature sensor in the pressure vessel. The measured temperature may be transmitted to a controller that may be configured to connect or isolate the pressure vessel to or from the working fluid stream. At step 1106, the method 1100 may include isolating the first pressure vessel from the working fluid stream when the respective temperature of the thermal storage medium in the first pressure vessel rises above the first threshold value (e.g., the maximum operating temperature). At step 1108, the method may include, after the respective temperature of the solid thermal storage medium in the first pressure vessel rises above a second threshold value (e.g., a maximum operating temperature or the maximum operating temperature minus an operating margin), connecting a second pressure vessel in the plurality of pressure vessels to the working fluid stream while a respective temperature of the solid thermal storage medium in the second pressure vessel is below a third threshold value (e.g., a maximum operating temperature for the second pressure vessel).

In some embodiments, the first threshold value and the second threshold value may be the same value. In such embodiments, when temperature of the thermal storage medium in the first pressure vessel rises above this value, the first pressure vessel is isolated from the working fluid stream and the second pressure vessel is connected to the working fluid stream. In other embodiments, the first threshold value and the second threshold value may be different values, for example, the second threshold value may be less than the first threshold value. In such embodiments, the first pressure vessel may remain connected to the working fluid stream when the second pressure vessel is connected to the working fluid stream. In another embodiment, the first threshold value, the second threshold value, and the third threshold value may be the same value. As examples, the first threshold value may be based on a maximum operating temperature (e.g., between $T_0^+$ and $T_1^+$) and the second threshold value may be based on a maximum operating temperature minus an operating margin.

In both methods 1000 and 1100, the first pressure vessel may be at a first pressure above atmospheric pressure after it is connected to the working fluid stream and the second pressure vessel may be at a second pressure below the first pressure before it is connected to the working fluid stream. The second pressure may be atmospheric pressure.

VI. Conclusion

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A thermocline system comprising:

an inlet fluid path, wherein the inlet fluid path receives a working fluid at a working pressure from a closed cycle system, wherein the working pressure is not atmospheric pressure;

an outlet fluid path, wherein the outlet fluid path returns the working fluid to the closed cycle system such that the working fluid is circulated through, in sequence, a turbine, a cold side heat exchanger, a compressor, and the thermocline system and in the same direction in both a charge mode and a discharge mode;

a plurality of pressure vessels, each pressure vessel of the plurality comprising:

an interior volume, an inlet valve configured to connect or isolate the interior volume to or from the inlet fluid path, an outlet valve configured to connect or isolate the interior volume to or from the outlet fluid path, and a thermal insulation configured to thermally insulate the pressure vessel from the atmosphere and from each other pressure vessel in the plurality of pressure vessels; and a solid thermal storage medium within the interior volume of each insulated pressure vessel of the plurality of pressure vessels, wherein at least one pressure vessel interior volume is connected to the inlet fluid path and the outlet fluid path, wherein at least one pressure vessel interior volume is isolated from the inlet fluid path and the outlet fluid path, wherein each pressure vessel interior volume connected to the inlet fluid path and the outlet fluid path is at the working pressure, and wherein each pressure vessel interior volume isolated from the inlet fluid path and the outlet fluid path is at a storage pressure that is not the working pressure.

2. The thermocline system of claim 1, wherein the inlet fluid path receives the working fluid at the working pressure from a Brayton cycle system, and wherein the outlet fluid path returns the working fluid to the Brayton cycle system.

3. The thermocline system of claim 1, wherein the solid thermal storage medium in each pressure vessel interior volume that is connected to the inlet fluid path and the outlet fluid path transfers thermal energy to the working fluid.

4. The thermocline system of claim 1, wherein the working fluid transfers thermal energy to the solid thermal storage medium in each pressure vessel interior volume that is connected to the inlet fluid path and the outlet fluid path.

5. The thermocline system of claim 1, wherein the storage pressure is atmospheric pressure.

6. The thermocline system of claim 1, wherein a ratio of working pressure to storage pressure is at least 3:1.

7. The thermocline system of claim 1, further comprising an equalization valve, wherein the equalization valve is configured to allow a pressure of each pressure vessel interior volume that is isolated from the inlet fluid path and the outlet fluid path to equilibrate to the storage pressure.

8. The thermocline system of claim 1, wherein the inlet fluid path is coupled to a working fluid path downstream of a compressor and upstream of a turbine in a Brayton cycle system.

9. The thermocline system of claim 1, wherein the solid thermal storage medium has porosity sufficient to allow the working fluid to flow through the solid thermal storage medium.

10. The thermocline system of claim 1, wherein each pressure vessel of the plurality further comprises an access port configured to permit loading of solid thermal storage medium into and out of the interior volume of the pressure vessel.

11. A method comprising:

operating a closed thermodynamic cycle system in a discharge mode, wherein a working fluid stream is circulated through, in sequence, a compressor, a thermocline array, a turbine, and a cold side heat exchanger and in the same direction in both a charge mode and the discharge mode, wherein the thermocline array comprises a plurality of pressure vessels, wherein each pressure vessel is configurable to be connected to the working fluid stream or isolated from the working fluid stream, and wherein each pressure vessel contains a solid thermal storage medium configured to transfer thermal energy to the working fluid stream when the pressure vessel is connected to the working fluid stream;

connecting a first pressure vessel in the plurality of pressure vessels to the working fluid stream while a respective temperature of the solid thermal storage medium in the first pressure vessel is above a first threshold value;

isolating the first pressure vessel from the working fluid stream when the respective temperature of the solid thermal storage medium in the first pressure vessel falls below the first threshold value; and after the respective temperature of the solid thermal storage medium in the first pressure vessel falls below a second threshold value, connecting a second pressure vessel in the plurality of pressure vessels to the working fluid stream while a respective temperature of the solid thermal storage medium in the second pressure vessel is above a third threshold value.

12. The method of claim 11, wherein the first threshold and the second threshold value are the same value.

13. The method of claim 11, wherein the first pressure vessel is at a first pressure above atmospheric pressure after it is connected to the working fluid stream and the second pressure vessel is at a second pressure below the first pressure before it is connected to the working fluid stream.

14. The method of claim 13, wherein the second pressure is atmospheric pressure.

15. A method comprising:

operating a closed thermodynamic cycle system in a charge mode, wherein a working fluid stream is circulated through, in sequence, a compressor, a thermocline array, a turbine, and a cold side heat exchanger and in the same direction in both the charge mode and a discharge mode, wherein the thermocline array comprises a plurality of pressure vessels, wherein each pressure vessel is configurable to be connected to the working fluid stream or isolated from the working fluid stream, and wherein each pressure vessel contains a solid thermal storage medium configured to receive thermal energy from the working fluid stream when the pressure vessel is connected to the working fluid stream;

connecting a first pressure vessel in the plurality of pressure vessels to the working fluid stream while a respective temperature of the solid thermal storage medium in the first pressure vessel is below a first threshold value;

isolating the first pressure vessel from the working fluid stream when the respective temperature of the solid thermal storage medium in the first pressure vessel rises above the first threshold value; and after the respective temperature of the solid thermal storage medium in the first pressure vessel rises above a second threshold value, connecting a second pressure vessel in the plurality of pressure vessels to the working fluid stream while a respective temperature of the solid thermal storage medium in the second pressure vessel is below a third threshold value.

16. The method of claim 15, wherein the first threshold value and the second threshold value are the same value.

17. The method of claim 15, wherein the first threshold value, the second threshold value, and the third threshold value are the same value.

18. The method of claim 15, wherein the first pressure vessel is at a first pressure above atmospheric pressure after it is connected to the working fluid stream and the second pressure vessel is at a second pressure below the first pressure before it is connected to the working fluid stream.

19. The method of claim 18, wherein the second pressure is atmospheric pressure.

20. A thermocline system comprising:

an inlet fluid path, wherein the inlet fluid path receives a working fluid at a working pressure from a closed cycle system, wherein the working pressure is not atmospheric pressure;

an outlet fluid path, wherein the outlet fluid path returns the working fluid to the closed cycle system such that the working fluid is circulated through, in sequence, a turbine, the thermocline system, a compressor, and a hot side heat exchanger and in the same direction in both a charge mode and a discharge mode;

a plurality of pressure vessels, each pressure vessel of the plurality comprising:

an interior volume, an inlet valve configured to connect or isolate the interior volume to or from the inlet fluid path, an outlet valve configured to connect or isolate the interior volume to or from the outlet fluid path, and a thermal insulation configured to thermally insulate the pressure vessel from the atmosphere and from each other pressure vessel in the plurality of pressure vessels; and a solid thermal storage medium within the interior volume of each insulated pressure vessel of the plurality of pressure vessels, wherein at least one pressure vessel interior volume is connected to the inlet fluid path and the outlet fluid path, wherein at least one pressure vessel interior volume is isolated from the inlet fluid path and the outlet fluid path, wherein each pressure vessel interior volume connected to the inlet fluid path and the outlet fluid path is at the working pressure, and wherein each pressure vessel interior volume isolated from the inlet fluid path and the outlet fluid path is at a storage pressure that is not the working pressure.

* * * * *